US005868617A

United States Patent [19]

Kim

[11] Patent Number: 5,868,617

[45] Date of Patent: Feb. 9, 1999

[54] DISCHARGE OUTLET OPENING AND CLOSING APPARATUS OF AIR CONDITIONER

[75] Inventor: Do-Yeon Kim, Euwang, Rep. of Korea

[73] Assignee: Samsung Electronics Co., Ltd., Suwon, Rep. of Korea

[21] Appl. No.: 813,653

[22] Filed: Mar. 7, 1997

[30] Foreign Application Priority Data

| | | | |
|---|---|---|---|
| Mar. 21, 1996 | [KR] | Rep. of Korea | 1996 5542 U |
| Mar. 21, 1996 | [KR] | Rep. of Korea | 1996 5543 U |
| Mar. 21, 1996 | [KR] | Rep. of Korea | 1996 7760 U |
| Mar. 21, 1996 | [KR] | Rep. of Korea | 1996 7761 |
| Mar. 21, 1996 | [KR] | Rep. of Korea | 1996 7762 |
| Mar. 21, 1996 | [KR] | Rep. of Korea | 1996 7763 |
| Mar. 21, 1996 | [KR] | Rep. of Korea | 1996 7764 |
| Mar. 21, 1996 | [KR] | Rep. of Korea | 1996 7765 |
| Mar. 21, 1996 | [KR] | Rep. of Korea | 1996 7766 |
| Mar. 21, 1996 | [KR] | Rep. of Korea | 1996 7767 |
| Mar. 21, 1996 | [KR] | Rep. of Korea | 1996 7768 |
| Mar. 21, 1996 | [KR] | Rep. of Korea | 1996 7769 |
| Dec. 3, 1996 | [KR] | Rep. of Korea | 1996 61291 |

[51] Int. Cl.[6] ..... E24F 13/20

[52] U.S. Cl. ..... 454/324; 49/214; 454/233

[58] Field of Search ..... 454/228, 230, 454/233, 234, 236, 259, 324, 334; 49/213, 214

[56] References Cited

U.S. PATENT DOCUMENTS

| | | | |
|---|---|---|---|
| 1,712,562 | 5/1929 | Jeffers | 49/214 |
| 4,733,511 | 3/1988 | Muth | 49/213 X |

FOREIGN PATENT DOCUMENTS

| | | | |
|---|---|---|---|
| 607361 | 8/1948 | United Kingdom | 49/214 |

*Primary Examiner*—Harold Joyce
*Attorney, Agent, or Firm*—Burns, Doane, Swecker & Mathis, L.L.P.

[57] ABSTRACT

An air conditioner, and more particularly to a discharge outlet opening and closing apparatus of an air conditioner for preventing foreign objects and the like from entering thereinto through a discharge outlet when the air conditioner is stopped of its operation, the apparatus adapted to be mounted with an open/close door for preventing foreign objects and the like from being infused through a discharge outlet opened at a front panel thereof at a predetermined size when the air conditioner is stopped of its operation, wherein the door is so disposed at the rear of the front panel for vertical movement as to rise up to an upper end of the discharge outlet according to a driving source and to move forward according to a second movement for closure of the discharge outlet and to thereby maintain a same flat surface as that of the front panel.

30 Claims, 27 Drawing Sheets

DISCHARGE OUTLET OPENING AND CLOSING APPARATUS OF AIR CONDITIONER

BACKGROUND OF THE INVENTION

1. Field of the Invention

The present invention relates to an air conditioner, and more particularly to a discharge outlet opening and closing apparatus of an air conditioner for preventing foreign objects and the like from entering thereinto through a discharge outlet when the air conditioner is stopped of its operation.

2. Description of the Prior Art

An air conditioner according to the prior art includes, as illustrated in FIG. 1, a front panel 20 centrally disposed, at a body of an indoor unit, a control unit 30 provided underneath the body 10 in order to suck into and discharge outside the atmospheric air.

The discharge outlet 40 is arranged with a suction grille 41 for supporting a filtering member (not shown) and for forming a beautiful exterior appearance thereof.

Another discharge outlet 50 is mounted at a predetermined spacing with a plurality of vertical wind direction blades 51 and horizontal wind direction blades 52 so as to control wind direction of cold wind supplied therethrough.

However, there is a problem in the air conditioner according to the prior art thus constructed in that foreign objects and the like are infused into an interior of the air conditioner when it is stopped of its operation to thereby result in frequent cleaning thereof.

There is another problem in that the foreign objects infused in the air conditioner are discharged indoors all at once through the discharge outlet 50 when the air conditioner is initially operated, to pollute the room air and to render an unpleasant feeling to a user, thereby deteriorating a cleanness of the room air.

There is still another problem in that an external appearance of the air conditioner looks unbecoming because it is all covered by a vinyl cover or the like lest the foreign objects should be infused into the interior of the air conditioner through the discharge outlet 50 when it is not used for a long time.

In order to overcome the above-mentioned problems, a discharge outlet opening and closing apparatus of an air conditioner is disclosed in Korean Utility model application No.95-13669 (applied on Jun. 16, 1995) by the present application.

The discharge outlet opening and closing apparatus of an air conditioner is mounted, as illustrated in FIGS. 2 and 3, with supporting means 60 to an indoor unit body 10, which is in turn coupled to driving means 70 so as to be driven in forward direction by an electric power according to a control signal of a control box 30.

The driving means 70 is coupled to a pinion 80 which receives a power therefrom, thereafter to be rotatatively actuated.

The pinion 80 is meshed with a rack gear 90 which receiver the rotary movement of the pinion 80 to thereafter perform a linear movement.

The rack gear 90 is provided with a door 100 which is vertically actuated by the vertical linear movement thereof and receives a guide from the support means 60 to thereby open and close a discharge outlet 50.

The support means 60 is disposed with a plurality of position detecting sensors 110 for detecting the vertical movement of the door 100.

Meanwhile, the support means 60 is arranged with a support member 61 having a through hole 61*a* at a predetermined position in order to allow the driving means 70 to be supported thereby.

The support member 61 is mounted (at both ends thereof with a plurality of wind direction vertical blades 51 and wind direction horizontal blades 52 so as to be guidingly supported in a spacing of the discharge outlet 50 formed above the support member 61, and at the same time, a guide member 62 is symmetrically mounted at the support member 61 so as to allow the door 100 to vertically move in front of the support member 61 to thereby open and close the discharge outlet 50.

The support member 61 is rotatively hinged at a central lower front surface thereof to a guide roller 63 so as to prevent the pinion 80 and rack gear 90 from being out of mesh, and, at the same time, to facilitate the rack gear 90 to vertically move according to an electric power of the pinion 80.

The pinion 80 is rotatively fixed to a motor axis 71 of driving means 70 so as to be rotated according to a driving force of the driving means 70.

The rack gear 90 is meshed to the pinion 80 at a bottom end thereof and is supported by the guide roller 63 lest it should be bolted therefrom.

The rack gear 90 is fixed at an upper end thereof by a central upper end of the door 100 and by a plurality of fastening bolts 91.

The door 100 is disposed with a body 101 for covering the discharge outlet 50.

The body 101 is rotatively hinged at both lower and upper ends thereof to rolling members 102 so that the body 101 can line-contact an inner surface of a concave unit 62*a* formed at the guide member 62 without being horizontally swayed to slide and to vertically move.

At this time, the body 101 is integrally formed at a bottom side thereof with a position-detecting protruder 103 so as to guide an operation of the plurality of position detecting sensors 110 when it is vertically operated.

However, there is a problem in the discharge outlet opening and closing apparatus of an air conditioner according to the prior art thus constructed, in that the door 100 is positioned at the rear of the discharge outlet 50, causing to generate a staired gap at a width surface of the discharge outlet 50 and to disfigure an external appearance thereof when a closed state of the discharge outlet 50 is viewed from the external apperance of the product as illustrated in FIG. 2, because the apparatus is structured such that the rack gear 90 vertically performs a first movement according to meshed cooperation between the pinion 80 and the rack gear 90 when the driving means 70 is driven to simultaneously activate the door 100 fixed at one side thereof and to open and close the discharge outlet 50.

SUMMARY OF THE INVENTION

Accordingly, the present invention is disclosed to solve the aforementioned problem and it is an object of the present invention to provide a discharge outlet opening and closing apparatus of an air conditioner by which a discharge outlet and a door are corresponded at a width surface of the door to thereby eliminate a staired gap therebetween and to beautify an external apperance of the air conditioner.

In accordance with one aspect of the present invention, there is provided a discharge outlet opening and closing apparatus of an air conditioner adapted to be mounted with an open/close door for preventing foreign objects and the like from being infused through a discharge outlet opened at a front panel thereof at a predetermined size when the air conditioner is stopped of its operation, wherein the door is so disposed at the rear of the front panel for vertical movement as to rise up to an upper end of the discharge outlet according to a driving source and to move forward according to a second movement for closure of the discharge outlet and to thereby maintain a same flat surface as that of the front panel.

In accordance with another aspect of the present invention, there is provided a discharge outlet opening and closing apparatus of an air conditioner adapted to be mounted with a door for preventing foreign objects and the like from being infused through a discharge outlet opened at a front panel thereof at a predetermined size when the air conditioner is stopped of its operation, the apparatus comprising:

left and right guide means arranged at the rear of the front panel such that a plurality of wind direction vertical blades can be rotatively supported at the discharge outlet and vertical movement of the door can be guided;

support means disposed at the rear of the front panel such that a plurality of wind direction horizontal blades can be horizontally rotated at the discharge outlet;

first driving means disposed at the support means to thereby be driven bidirectionally; and power transmission means provided at the support means so as to receive a power of the first driving means to vertically move the door.

In accordance with still another aspect of the present invention, there is provided a discharge outlet opening and closing apparatus of an air conditioner adapted to be mounted with a door for preventing foreign objects and the like from being infused through a discharge outlet opened at a front panel thereof at a predetermined size when the air conditioner is stopped of its operation, wherein the apparatus is disposed at the rear of the front panel with a discharge outlet opener and closer for vertically moving the door, so that the door can be raised up to an upper end of the discharge outlet according to a driving source and horizontally moved according to sliding motion of inclination method to thereby close the discharge outlet.

BRIEF DESCRIPTION OF THE DRAWINGS

For fuller understanding of the nature and objects of the invention, reference should be made to the following detailed description taken in conjunction with the accompanying drawings in which:

FIG. 5 is a perspective view of an air conditioner according to the first embodiment of the present invention;

FIGS. 6, 6A and 6B are exploded perspective views for illustrating a discharge outlet opening and closing apparatus according to the embodiment of the present invention;

FIG. 7 is an exploded perspective view for illustrating a fixed member and a periphery thereof according to the embodiment of the present invention;

FIG. 8 is an exploded perspective view for illustrating a rack gear, a rack guide member and a periphery thereof according to the embodiment of the present invention;

FIG. 9 is an exploded perspective view for illustrating upper and lower links and peripheries thereof according to the embodiment of the present invention;

FIG. 10 is an exploded perspective view for illustrating support means and a periphery thereof according to the embodiment of the present invention;

FIG. 11 is an exploded perspective view for illustrating left and right blade swing driving means and a periphery thereof according to the embodiment of the present invention;

FIG. 12 is a sectional view of principal parts at a joint box and a periphery thereof according to the embodiment of the present invention;

FIG. 13 is an exploded perspective view for illustrating guide means and a periphery thereof according to the embodiment of the present invention;

FIG. 14 is an operational constitutional diagram for illustrating a state where a discharge outlet is opened by a door according to the embodiment of the present invention;

FIG. 15 is n operational constitutional diagram for illustrating a state where a discharge outlet is closed by a door according to the embodiment of the present invention;

FIG. 16 is a perspective view for illustrating principal parts of a discharge outlet opening and closing apparatus according to the second embodiment of the present invention;

FIG. 17 is a horizontal sectional view taken along line A—A in FIG. 16;

FIG. 18 is a schematic diagram for illustrating a state where a door is lowered to thereby open a discharge outlet;

FIG. 19 is an operational constitutional diagram for illustrating a door being raised;

FIG. 20 is a schematic diagram for illustrating a state where a door is raised to thereby close a discharge outlet;

FIG. 21 is a perspective view for illustrating principal parts of a discharge outlet opening and closing apparatus;

FIG. 22 is a horizontal sectional view taken along line B—B of FIG. 21;

FIG. 23 is a vertical sectional view for illustrating safety means in FIG. 22;

FIG. 24 is a perspective view for illustrating the safety means in FIG. 23;

FIG. 25 is a schematic diagram for illustrating a state where a door is lowered to thereby open a discharge outlet;

FIG. 26 is an operational constitutional diagram of the door being raised; and FIG. 27 is a schematic diagram for illustrating a state where the door is raised to thereby close the discharge outlet.

DETAILED DESCRIPTION OF THE INVENTION

Figure 1:
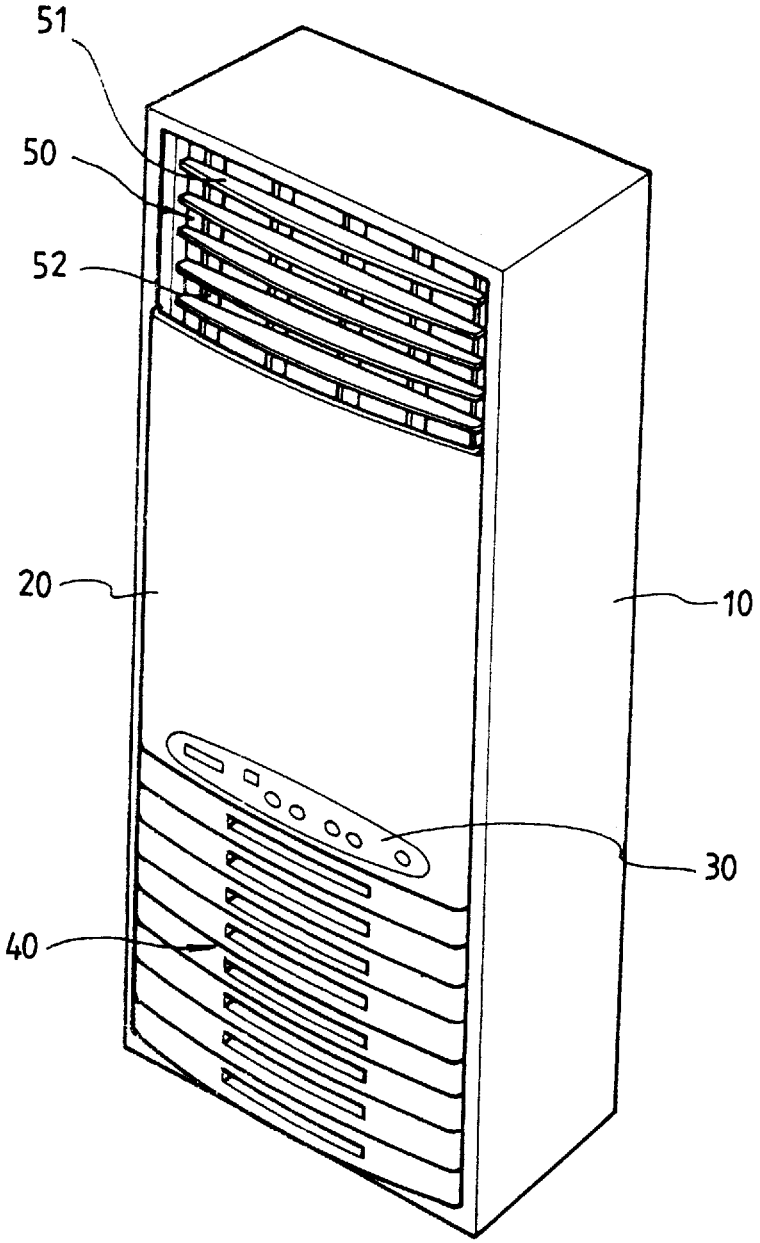
FIG.1 (PRIOR ART)
FIG. 1 is a perspective view for illustrating an air conditioner according to one embodiment of the prior art.
Figure 2:
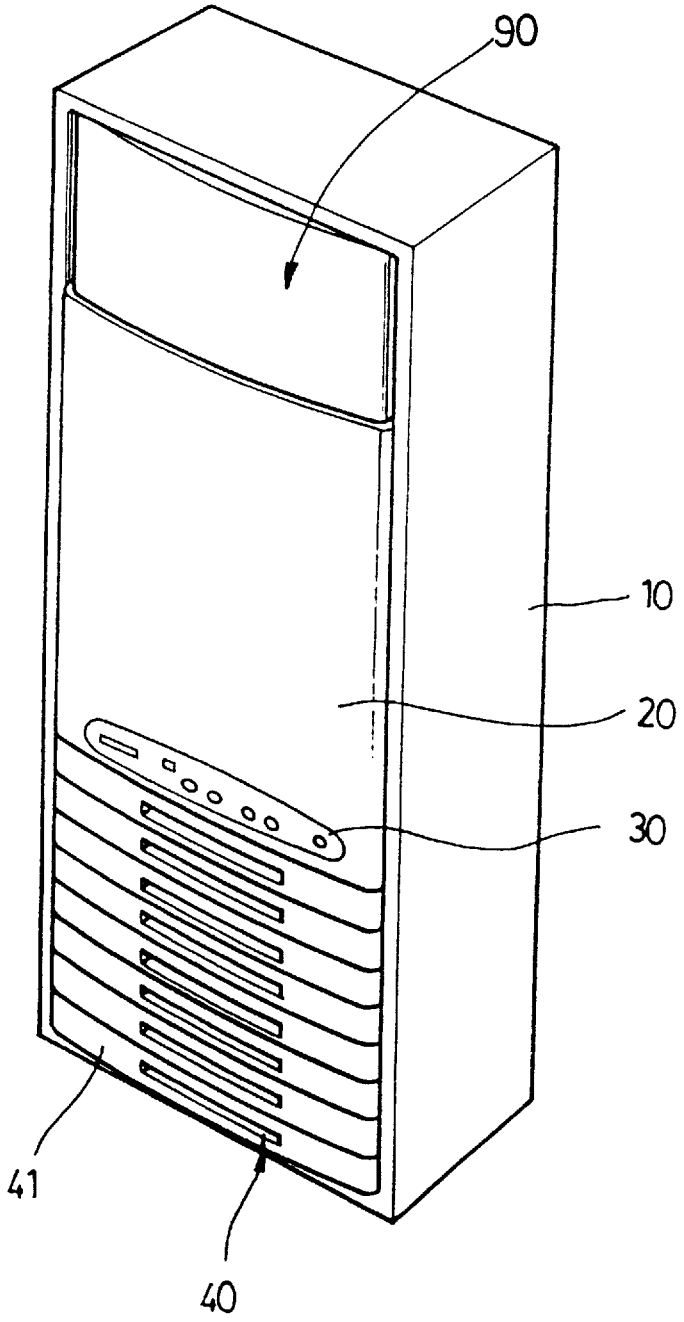
FIG.2 (PRIOR ART)
FIG. 2 is a perspective view for illustrating an air conditioner according to another embodiment of the prior art.
Figure 3:
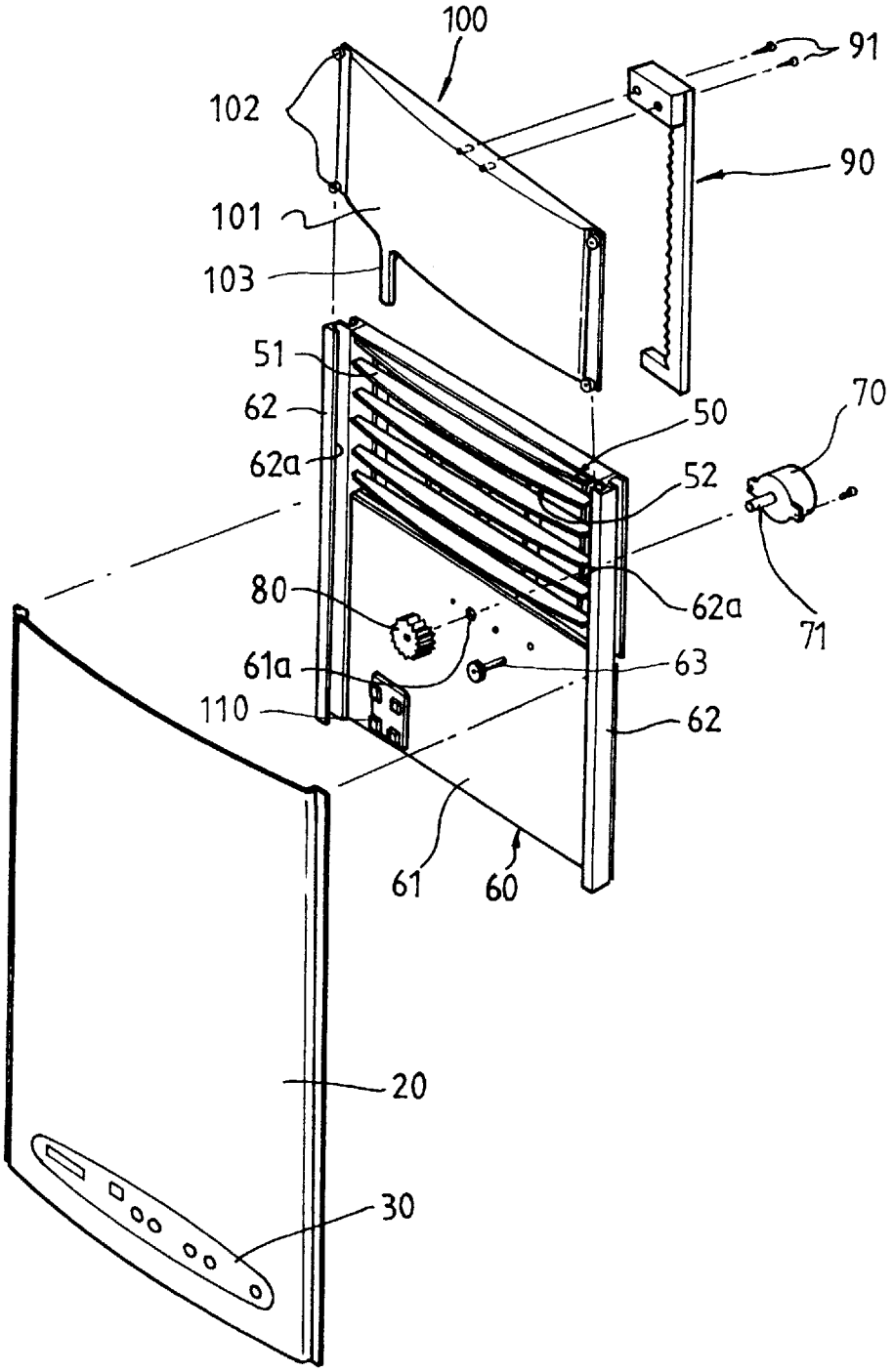
FIG. 3 (PRIOR ART)
FIG. 3 is an exploded perspective view for illustrating a discharge outlet opening and closing apparatus in FIG. 2.
Figure 4:
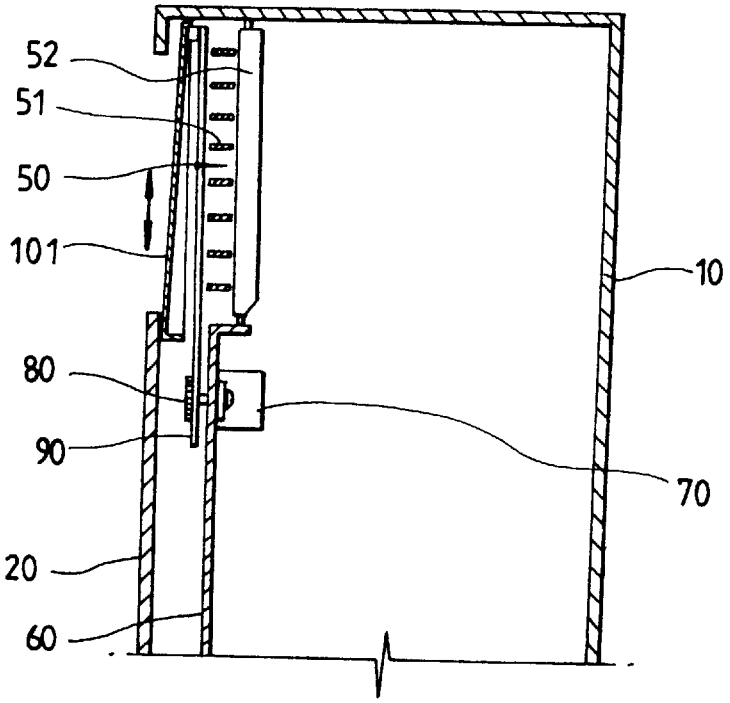
FIG.4 (PRIOR ART)
FIG. 4 is a side sectional view for illustrating principal parts in FIG. 3.

The preferred embodiments of the present invention will now be described in detail with reference to the accompanying drawings and firstly, a first embodiment will be described with reference to FIGS. 5 through 8.

FIRST EMBODIMENT

Throughout the drawings, like reference numerals and symbols are used for designation of like or equivalent parts or portions, for simplicity of illustration and explanation.

Reference numeral 200 defines a discharge outlet opening and closing unit which serves to raise an open/close door to a predetermined height according to a driving source to thereby prevent foreign objects and the like from entering the air conditioner when the air conditioner is not working, and to correspond a side surface of a discharge outlet with that of the open/close door according to a two-dimensional motion generated by a lower end of the open/close door which moves forward, to thereby eliminate a staired gap therebetween and to thereafter close the discharge outlet.

Figure 6A:
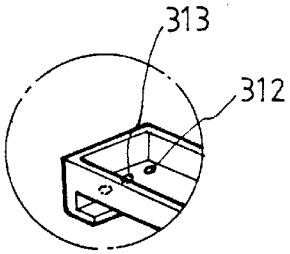
Figure 6:
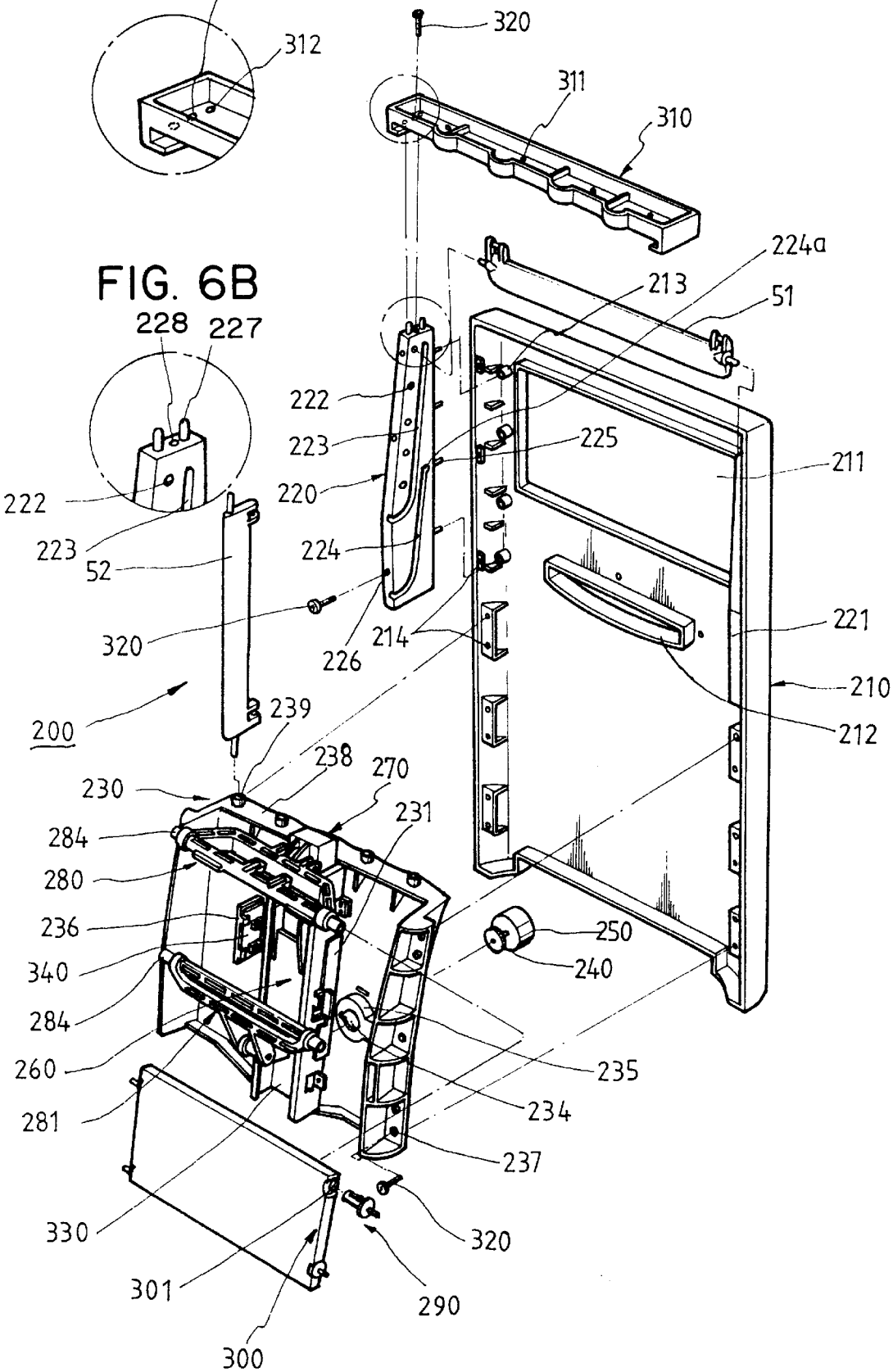
Figure 7:
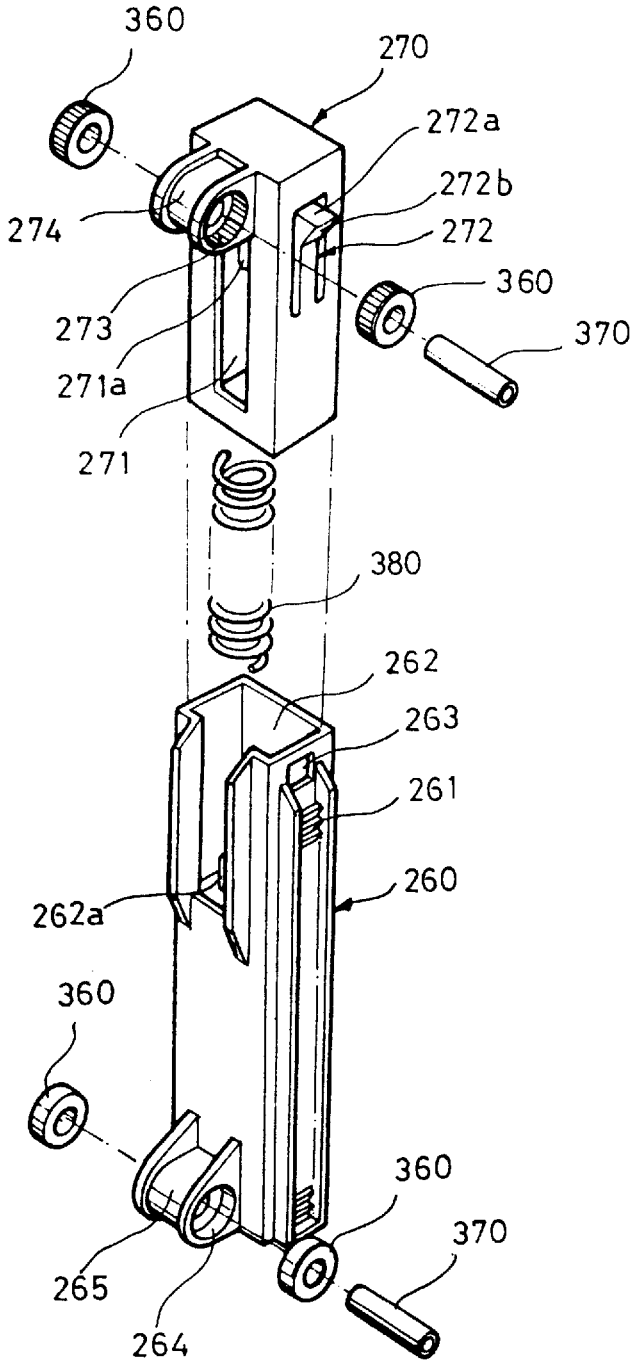
Figure 8:
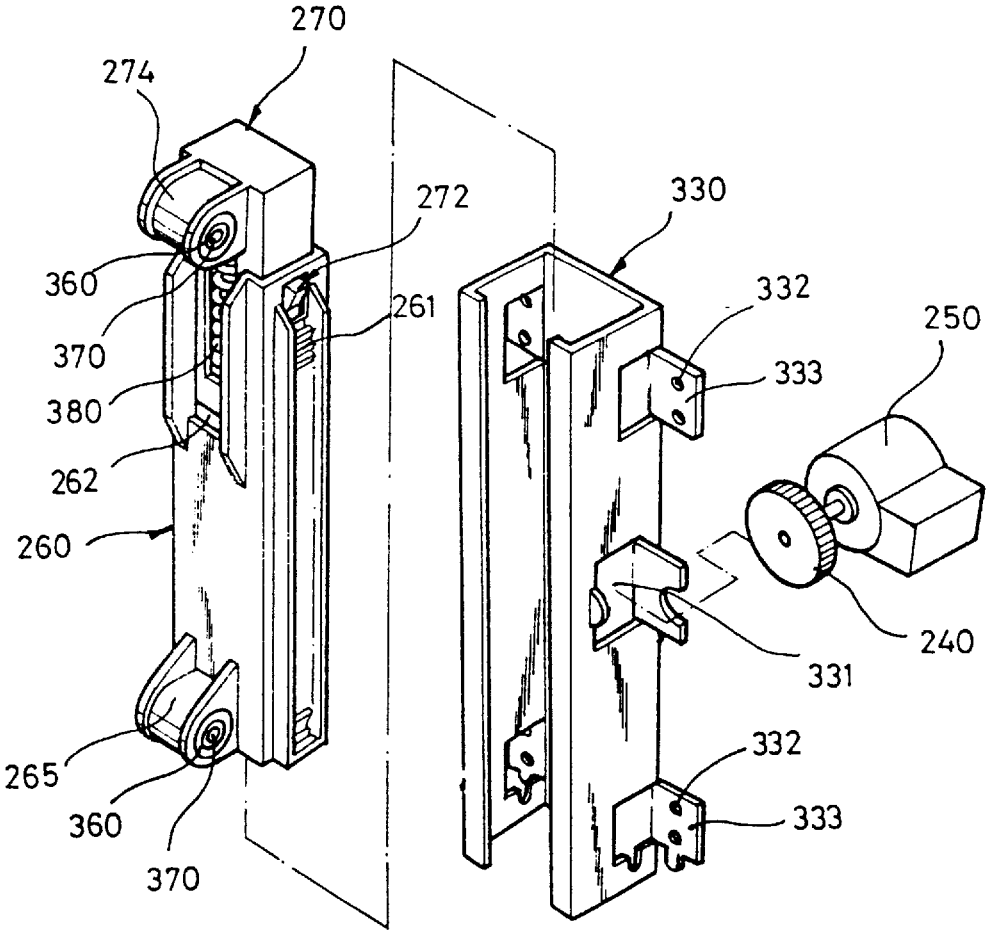
Figure 9:
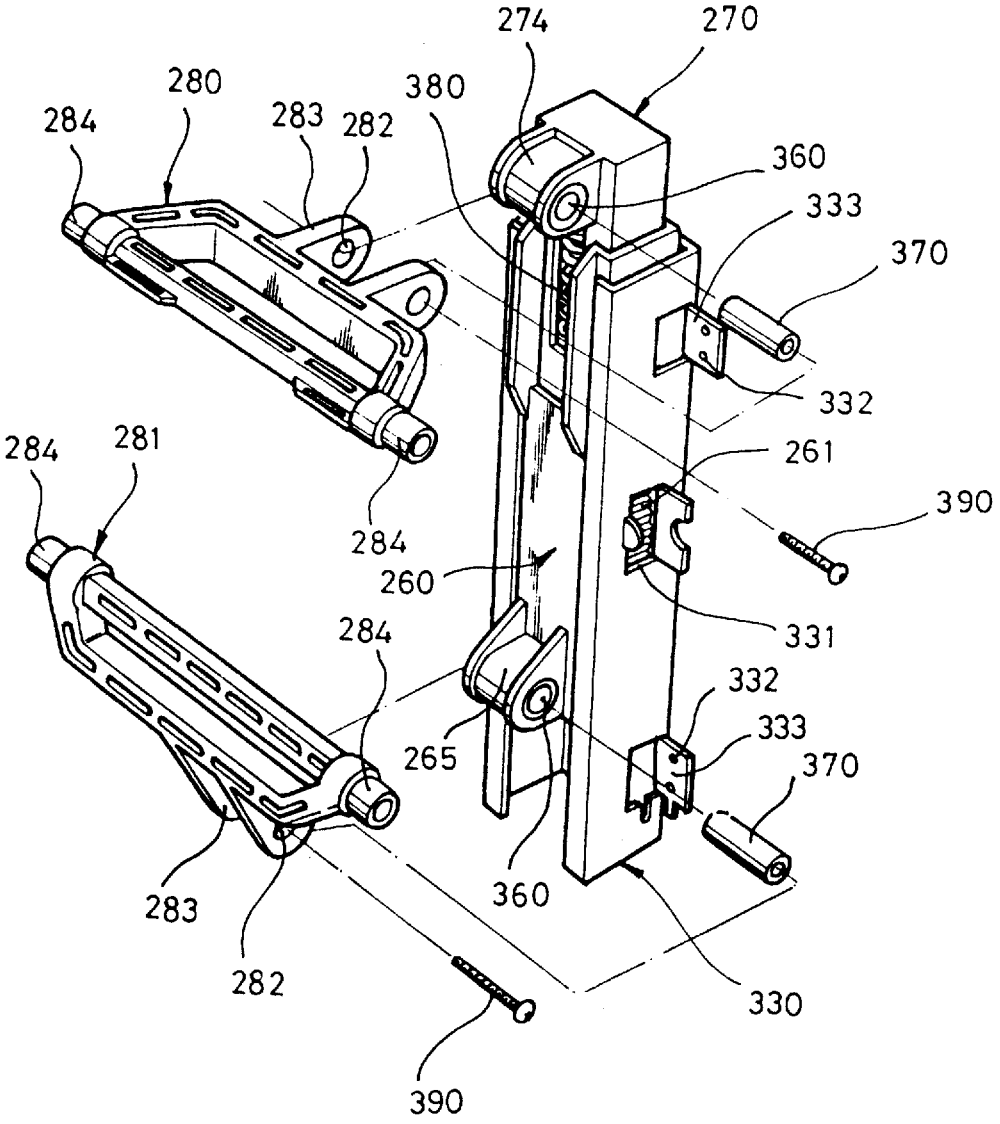
Figure 10:
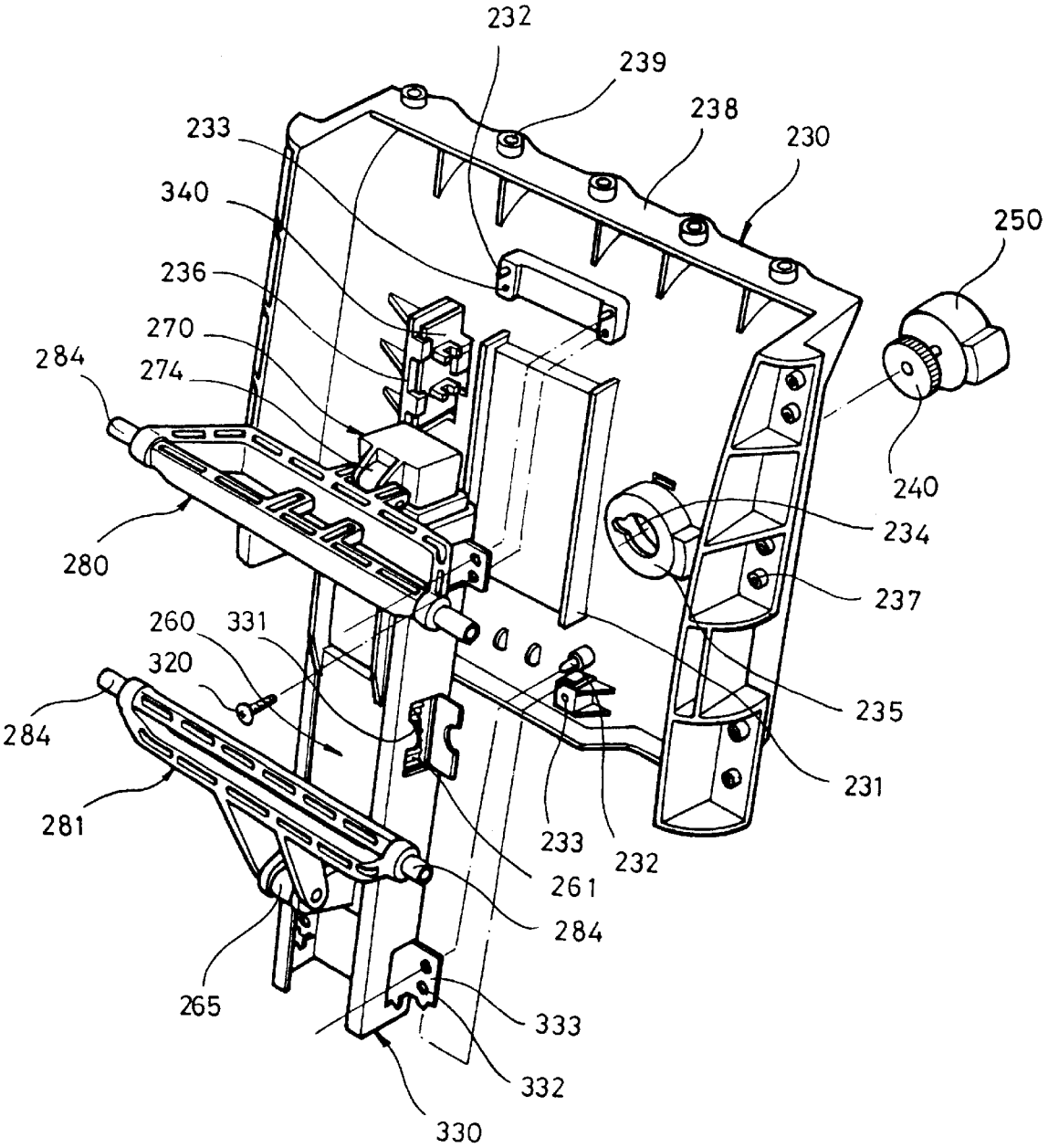
Figure 11:
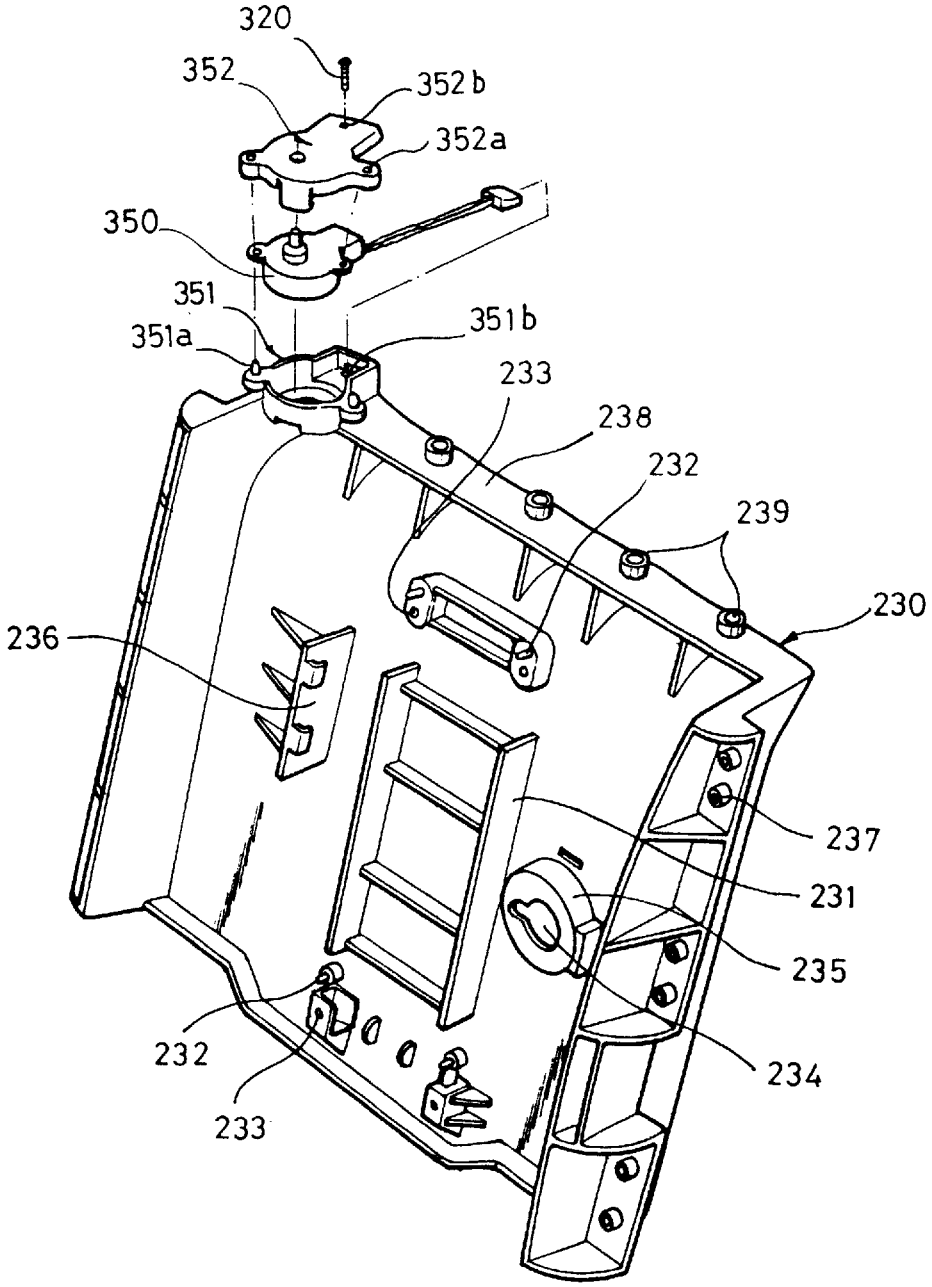
Figure 12:
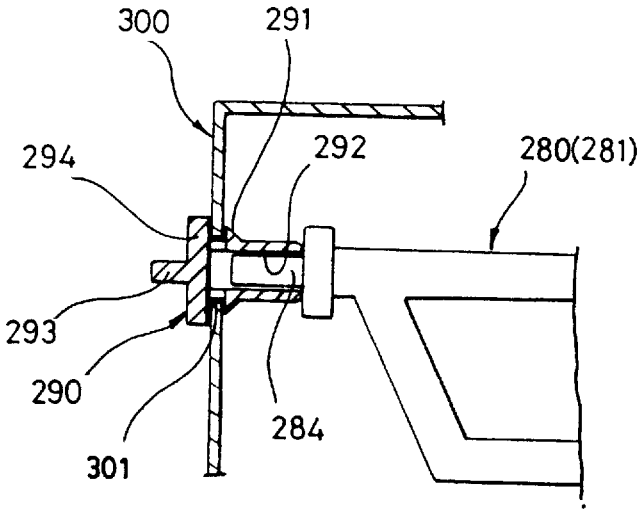
Figure 13:
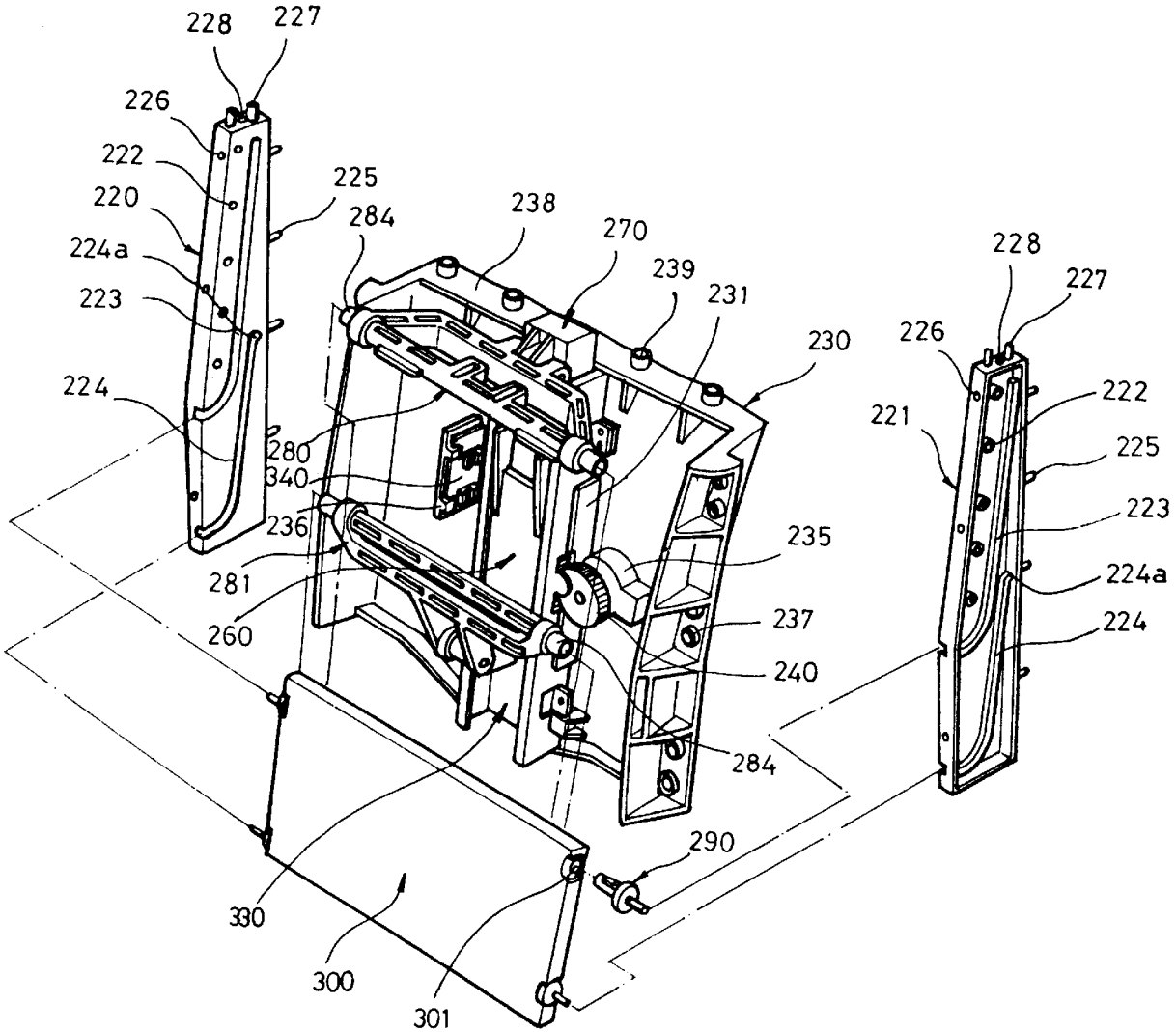

In other words, the discharge outlet opening and disclosing unit 200 includes, as illustrated in FIG. 6, a front panel 210 arranged to guide the air in the air conditioner to be discharged outside through an upper area thereof and to cover a front surface of an indoor unit body 10, left and right guide means 220 and 221 symmetrically disposed at both upper ends facing a rear side of the front panel 210 so that a plurality of horizontal wind direction blades 51 can be rotated at a rear side thereof, support means 230 disposed underneath a rear surface of the front panel 210 so that a plurality of vertical wind direction blades 52 can be rotated at a rear side thereof, a first driving means 250 disposed at a rear side of the support means 230 so as to bidirectionally rotate a pinion 240 positioned at a rear side of the support means 230, a rack gear 260 provided at a rear side of the support means 230 so as to be raised or lowered according to activation of the pinion 240, a fixing member 270 mounted at an upper end of the rack gear 270 so as to be simultaneously raised by ascending operation of the rack gear 260 and to be resiliently narrowed in gap with the rack gear 260 when it is collided by external force, upper and lower connecting members 280 and 281 hinged to rear sides of the rack gear 260 and the fixing member 270 at a predetermined spacing so as to respectively perform articulatory motions, and an open/close door 300 simultaneously hinged to the left and right guide means 220 and 221 and the upper and lower connecting means 280 and 281 by a plurality of joint boxes 290 so as to be vertically moved by guides of the left and right guide means 220 and 221 to thereby open or close a discharge outlet.

At this location, the front panel 210 is piercingly formed at an upper end thereof with a discharge outlet 211 having a predetermined area so as to discharge outside the air heat-exchanged within the air conditioner, and is piercingly disposed at a central portion thereof with a control box accommodation hole 212 having a predetermined area so as to accommodate a control box 30 therein.

The front panel 210 is formed at both ends thereof from a rear intermediate area to an uppermost area thereof with a plurality of snap holes 213 at a predetermined spacing therebetween so that the left and the right guide members 220 and 221 can be fitted thereinto.

Moreover, the front panel 210 is formed at both inner walls thereof from a rear lower area to the intermediate area thereof with a plurality of fastening screw holes 214 at a predetermined interval therebetween so that the left and right guide means 220 and 221 and the support means 230 can be respectively coupled at corresponding areas by fastening method.

Meanwhile, left and right guide means 220 and 221 are respectively formed up and down with a plurality of hinge holes, each being located at a predetermined spacing from an intermediate height to an uppermost height thereof against both lateral walls thereof so that the horizontal wind direction blades 51 can be symmetrically fitted at both ends thereof to freely and vertically be operated.

The left and right guide means 220 are formed from an intermediate place thereof to an uppermost place thereof against both inner lateral walls thereof with an upper rail groove 223 so that the joint boxes 290 respectively mounted at both upper ends of the open/close door 300 can be guided to thereby be moved vertically, and are formed from a lower place thereof to the intermediate place thereof against both inner walls with a lower rail groove 224 so that the joint boxes respectively mounted at two lower ends of the open/close door 300 can be guided to thereby be moved vertically.

At this location, the upper rail groove 223 is horizontally and upwardly formed at a predetermined inclination at a lower end thereof from an intermediate rear place of the left and right guide means 220 and 221 to an intermediate front place, but is vertically bent at a predetermined inclination at a tip end thereof toward a front upper end of the left and right guide means 220 and 221.

The lower rail groove 224 is horizontally and upwardly formed at a predetermined inclination at a lower end thereof from a lower rear end of the left and right guide means 220 and 221 to an intermediate portion thereof while a tip end of the lower rail groove 224 is bent at right angle at the intermediate portion of the left and right guide means 220 and 221 until it is horizontally and forwardly bent at a predetermined angle.

The lower rail groove 224 is formed at an upper end thereof with a bent unit 224*a* lower end of the open/close door 300 can horizontally and forwardly move for a discharge outlet 211 to thereby eliminate a staired gap between a lower width of the open/close door 300 and a lower width of the discharge outlet 211.

The upper and lower rail grooves 223 and 224 are opened outside of the guide means 220 and 221 so that one end of the plurality of joint boxes 290 can be accessed for a mutual hinged coupling.

Furthermore, the left and right guide means 220 and 221 are formed at front sides thereof with a plurality of snap protruders 225 so as to correspondingly fitted to a plurality of snap holes 213 formed at the rear of the front panel 210.

The left and right guide means 220 and 221 are formed at rear surface thereof with a plurality of bolt through holes 226 so as to be correspondingly fitted to a plurality of fastening thread holes 214 to thereafter be fastened by a plurality of fastening bolts 320.

The left and right guide means 220 and 221 are formed at upper surfaces thereof with a snap protruder 227 and a fastening screw hole 228 so that a left and right blade support plate 310 for supporting an upper end of the vertical wind direction blade 52 can be coupled.

At this location, the left and right blade support plate 310 is formed between two upper ends thereof with a plurality of hinge holes 311 at respectively predetermined spaces so that an upper end of the horizontal wind direction blade 52 can be fitted to thereby be rotated horizontally and freely.

The left and right blade support plate 310 is formed at both upper ends thereof with a snap hole 312 and a screw through hole 313 so as to be correspondingly fitted to the snap protruder 227 and the fastening screw hole 228 formed at upper surfaces of the left and right guide means 220 and 221.

Meanwhile, the support means 230 is protrudingly disposed at a rear central portion thereof with a position fitting unit 231 so that a rack guide member 330 for guiding a vertical motion of the rack gear 260 cannot be horizontally swayed.

The position fitting unit 231 is formed at an upper section and a lower section thereof with a plurality of snap protruders 232 and fastening screw holes 233 such that the rack guide member 330 can be fitted respectively at an upper end and a lower and thereof.

The position fitting unit 231 is protrudingly formed at a right side thereof with a driving means fixing accommodation unit 235 mounted with a pinion through hole 234 such that the first driving means 250 can be insertedly mounted through a front side thereof.

At this location, the rack guide member 330 is opened at a central front portion thereof and at upper and lower surfaces thereof to allow the rack gear 260 to be inserted through an upper portion thereof and to thereafter be horizontally operated, and to allow the pinion 240 to pass therethrough at a midsection of a right side wall thereof and to be meshed with the rack gear 260.

The cut-out portion 331 is formed at both lower and upper wall surfaces thereof with a flange with 333 having a plurality of fixing holes 332 at both side walls thereof so as to be correspondingly fitted to the plurality of snap protruders 232 and fastening screw holes 233 formed at the rear of the support means 230.

Furthermore, the support means 230 is protrudingly disposed at a left side of the position fitting unit 231 with a sensor fixing unit 236 to allow a photo sensor 340 for position-detecting a vertical motion of the rack gear 260 to be inserted from forward to backward, and at both ends thereof is formed with a plurality of screw through holes 237 so as to be corresponded with the plurality of fastening screw holes 214 formed at both inner rear walls of the front panel 210 to thereafter be coupled by fastening bolts 320.

The support means 230 is foldingly formed at an upper surface thereof with a left and right blade support unit 238 for supporting a lower end of the plurality of horizontal wind direction blades 52.

At this location, the left and right blade support unit 238 is formed between both upper ends thereof with a plurality of hinge holes 239, each being spaced out at a predetermined interval, so that a lower end of the plurality of vertical wind direction blades 52 can be fitted for free horizontal rotation, and is formed at an upper end thereof with a second driving means 350 for horizontally moving the plurality of vertical wind direction blades 52.

In other words, the second driving means 350 includes therein an accommodation unit 351 integrally formed at an upper end of the left and right blade support unit 238, a plurality of snap protruders 351*a* formed at an opening located above the accommodation unit 351, and a lid plate mounted with a snap hole 352*a* and a screw through hole 352*b* corresponding to fastening screw hole 351*b*.

Meanwhile, the rack gear 260 includes gear teeth 261 to be vertically meshed with the pinion 240 at one side wall thereof, an accommodation unit 262 for being inserted through an upper side of the fixing member 270 to thereby perform a vertical-direction dampering action, a hitching groove 263 for allowing the fixing member 270 to be inserted into the accommodation unit 262 and to thereafter be coupled thereto resiliently, and a rib 265 mounted with an axle hole 264 for allowing lower connecting member 281 to be inserting thereinto for vertical rotation.

At this location, the accommodation unit 262 includes a damper fixing pin 262*a* disposed at a floor thereof for preventing a damper member (described later) from being bolted therefrom so that the damper member can accurately perform a damping operation, bearings 360 respectively fitted into an inner ends of the axle hole 264 by way of serration method, and a bush 370 forcibly inserted into the inner ends of the bearings 360 and having the same width as that of the rib 265.

Meanwhile, the fixing member 270 is mounted with an insertion unit 271 disposed thereunder and having a predetermined depth for the damper member 380 to be inserted thereinto to thereby perform a damping operation, a hook protruder 272 formed at both upper ends thereof by way of cut-out so as to be resiliently coupled to a hitching groove 263 formed at the rack gear 271, and a rib 274 disposed at an upper rear surface thereof and having an axle hole 273 for the connecting member 280 to be inserted thereinto for vertical rotation.

The insertion unit 271 is integrally provided at a ceiling thereof with a damper fixing pin 271*a* for preventing the damper member 380 from being bolted therefrom so that the damper member 380 can accurately perform a vertical damping operation.

The hook protruder 272 is arranged with a horizontal jaw 272*a* formed at an upper surface thereof for preventing the fixing member 270 from being separated from an upper area of the rack gear 260 by being hitched by an upper surface of hitching groove 263 formed at the rack gear 260, and a slant jaw 272*b* formed thereunder for sliding to narrow a gap therebetween by way of a stopping force from the fixing member which is adhered to a bottom surface of the hitching groove 263 and by way of an asending force of the rack gear 260.

The axle hole 273 is fitted thereinto at both inner ends thereof with bearings 360 by way of serration method, and the bearings 360 are forcibly inserted thereinto with a bush 370 having the same width as that of the rib 274.

The damper member 380 which is a compressed spring is adhered at a lower end thereof to a floor surface of accommodation unit 262 formed at an upper end of the rack gear 260, and is stuck at an upper end thereof to a ceiling of insertion unit 271 formed underneath the fixing member 270.

Meanwhile, the upper and lower connecting members 280 and 281 are protrudingly disposed at a central front portion thereof with a rib 283 having an axle hole 282 so as to be respectively hinged to the fixing member 270 and the rack gear 260 through the medium f a hinge axle 390, and are respectively formed at both rear ends thereof with hinge pins 284 so as to be hinged to the open/close door 300 through the media of the joint boxes 290.

Furthermore, the plurality of joint boxes 290 are fitted at one end thereof to an external surface of the hinge pin 284 protruded to the upper and lower connecting members 280 and 281 through upper and lower lateral walls of the open/close door 300, and are accommodated at the other end thereof to upper and lower rail grooves 223 and 224 formed at the left and right guide means 220 and 221.

In other words, the plurality of joint boxes 290 are formed at one end thereof with a hollow axle unit 292 having at least one hooked protruder 291 formed at an external surface thereof which is resiliently pierced through a lateral wall of the open/close door 300 to thereafter be forcibly fitted to an external surface of the hinge pin 284 protruded at both ends of the upper and the lower connecting members 280 and 281, and are formed at the other end thereof with an axle unit 293 so as to be selectively inserted into left and right rail grooves 223 and 224 of the left and right guide means 220 and 221 and to thereafter slide therein.

The plurality of joint boxes 290 are also formed between the hollow axle unit 292 and the axle unit 293 with a flange unit 294 having a larger diameter than external diameters thereof to be adhered to an external wall of the open/close door 300 and to thereby function as a washer.

At this time, the joint boxes 290 respectively mounted at both upper lateral walls of the open/close door 300 out of the plurality of joint boxes 290 mentioned above, are respectively fitted into the upper rail groove 223 of the left and right guide means 220 and 221.

The joint boxes 290 respectively disposed at both lower lateral walls of the open/closed door 300 are respectively fitted into the lower rail groove 224 of the left and right guide means 220 and 221.

The open/close door 300 is respectively and piercingly formed at both lateral walls against an upper end and a lower end thereof with an axle hole 301 so that the joint boxes 290 can be resiliently inserted to thereby be hinged to hinge pin 284 of the upper and lower connecting members 280 and 281 respectively.

Next, an operational effect of the present invention according to the first embodiment thus constructed will be described.

When a control box 30 or a remotely controlled unit (not shown) disposed at the front panel 210 is manipulated to operate the first driving means 250 so that the discharge outlet 211 can be closed in a state where the air conditioner is stopped of its operation, the first driving means 250 is driven at one direction to simultaneously rotate pinion 240 fixed to a driving means axis (no reference numeral given) at one direction, where the pinion 240 serves to asend the meshed rack gear 260 and at the same time, to raise the fixing member 270 disposed with the damper member 380 mounted above the rack gear 260.

Furthermore, the fixing member 270 serves to raise the upper connecting member 280 hinged at one end thereof to an upper end thereof and simultaneously hinged at the other end thereof to an upper end of the open/close door 300 through the medium of the joint box 290.

The rack gear 260 serves to raise the lower connecting member 281 hinged at one end thereof to a lower end thereof and simultaneously hinged at the other end thereof to a lower end of the open/close door 3000 through the medium of the joint box 290.

At this location, the joint box 290 which pierces through both upper lateral walls of the open/close door 300 is raised for operation along upper rail groove 223 formed at the left and right guide means 220 and 221, to thereby support and upward operation at an upper end of the open/close door 300, and the joint box 290 which pierces through both lower later walls of the open/close door 300 is raised for operation along lower rail groove 224 formed at the left and right guide means 220 and 221, to thereby support and upward operation at a lower end of the open/close door 300.

Successively, the open/close door 300 collides at an upper surface thereof with a staired surface because of an upper width of the discharge outlet 211 when the door 300 is to be raised, thereby preventing same from being raised up. At this time, a resistant force therefrom is transmitted to the upper connecting member 280 hinged to the open/close door 300, and, at the same time, is transmitted to the fixing member 270 hinged to the upper connecting member 280 whereby, the fixing member 270 is no longer raised to thereby be stopped at a predetermined position.

However, the rack gear 260 is a little further raised up for operation by rotary movement of the pinion 240 when the fixing member 270 is stopped of ascent, to thereby compress damper member 380 and to narrow a gap with the fixing member.

Figure 15:
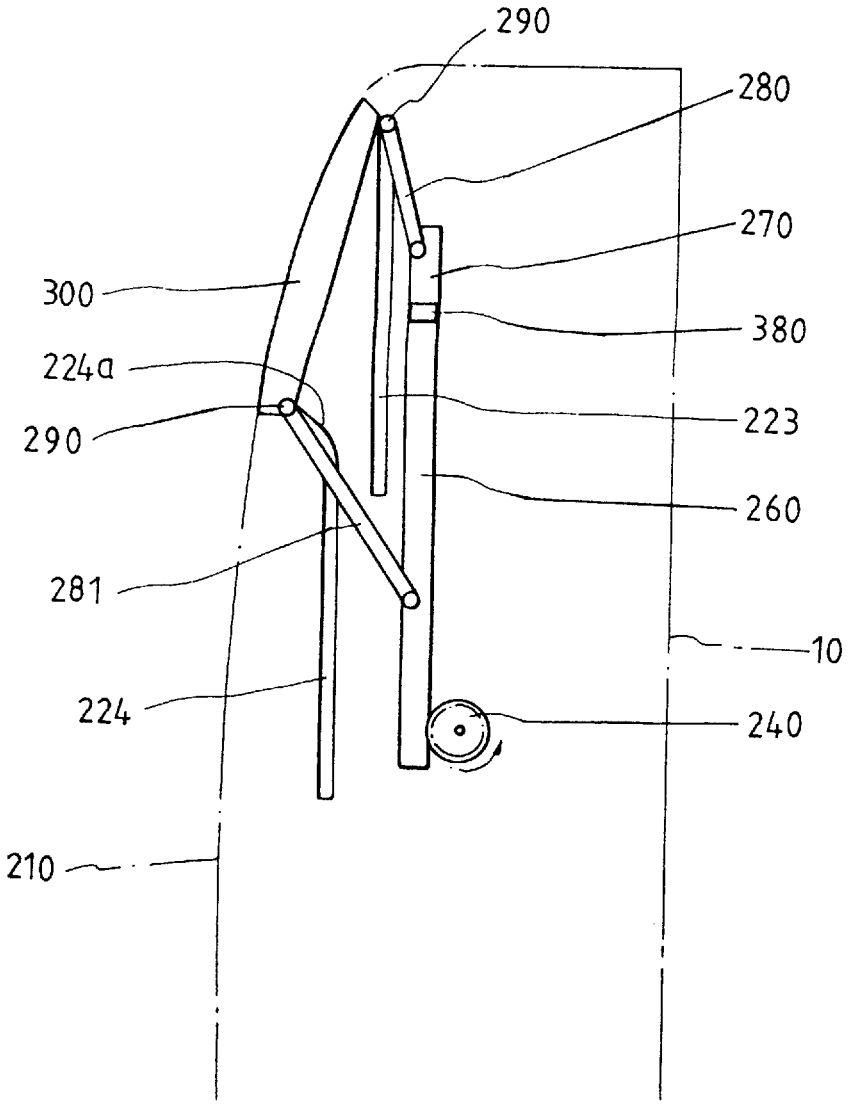
Figure 16:
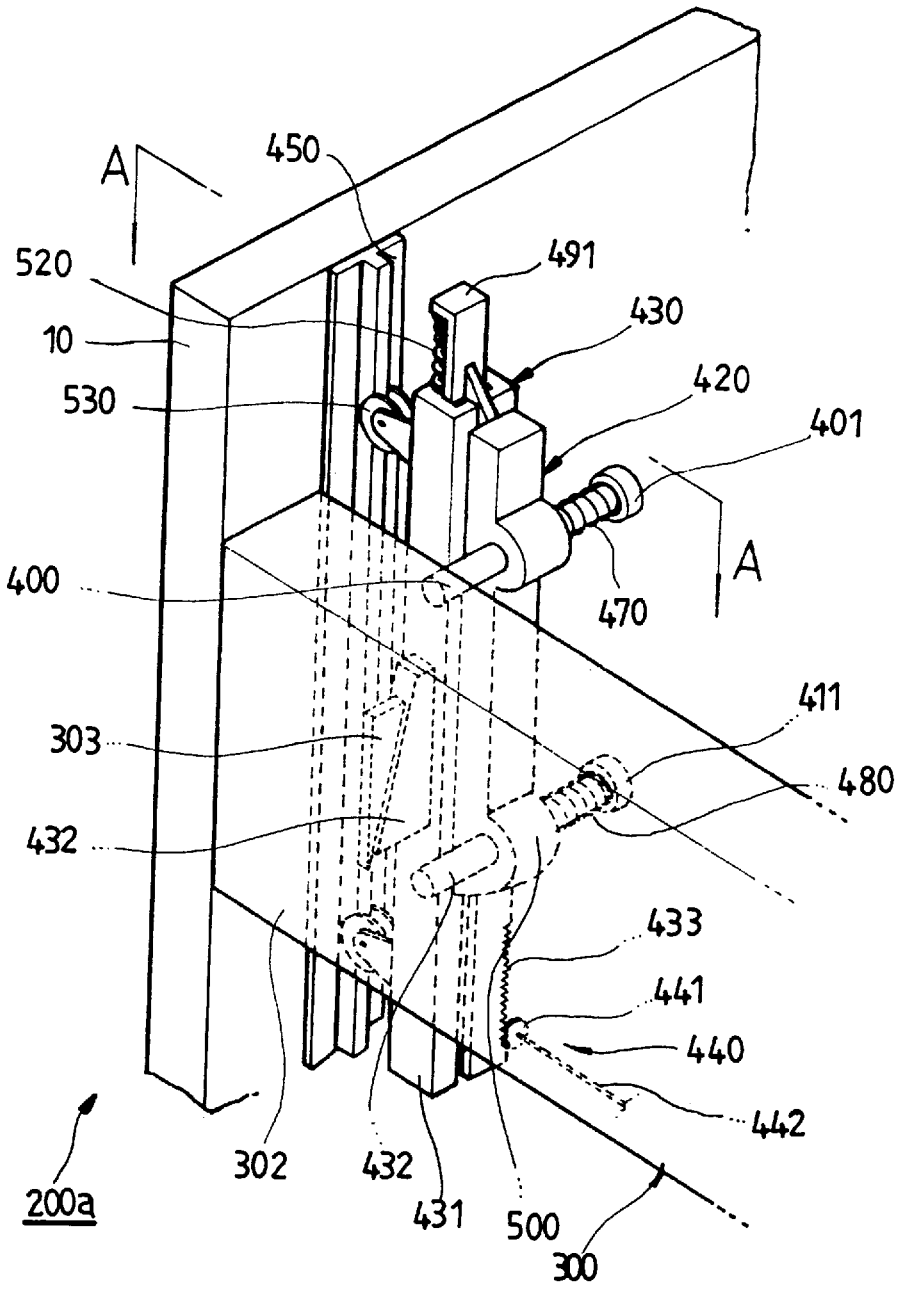
FIGS. 16 through 20 are drawings according to a second embodiment of the present invention where.
Figure 17:
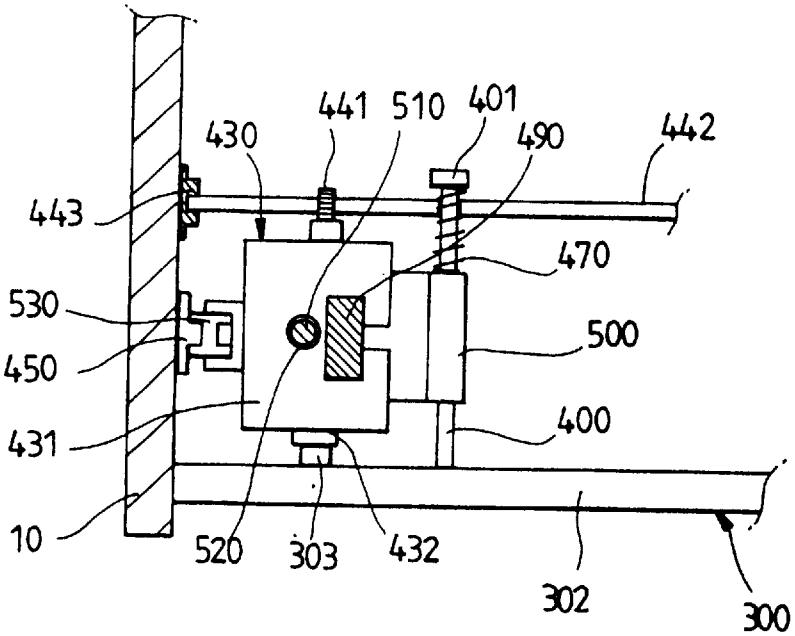

The open/close door 300 is accommodated at a lower width of the discharge outlet 211 according as the joint box 290 hinged at a lower portion of the open/close door 300 performs a horizontal secondary movement along an upper bend unit 224*a* of the lower rail groove 224 by way of a force of the rack gear 260 which tends to ascend farther up than the fixing member 270, so that a width at an external peripheral surface of the open/close door 300 and an internal peripheral surface of the discharge outlet 211 can be corresponded, as illustrated in FIG. 15, to thereby eliminate a staired gap against the internal peripheral width of the discharge outlet 211 and to beautify an external appearance of the air conditioner.

Furthermore, the open/close door 300 serves to close the discharge outlet 211 to thereby prevent foreign objects in and out of the air conditioner from being infused thereinto through the discharge outlet 211.

Moreover, a pure cool air free of foreign objects and the like can be infused indoors to increase cleanliness of the room air and to provide a user with a pleasant atmosphere when an air conditioner is activated with the discharge outlet 211 reopened in a state where the discharge outlet 211 has been closed for a certain period of time.

Next, when the user manipulates the control box 30 or a remotely-controlled unit (not shown) provided at the front panel 210 to thereby start the first driving means 250 so that the discharge outlet 211 can be opened, the first driving means 250 is driven in the reverse direction to simultaneously rotated the pinion 240 in the reverse direction.

The pinion 240 then serves to descend the meshed rack gear 260, and when the rack gear 260 is descended, the fixing means 270 mounted thereof, stopped at movement during a period while and damper member 380 is released of compression movement thereof, is simultaneously descended by traction of the rack gear 260.

Figure 14:
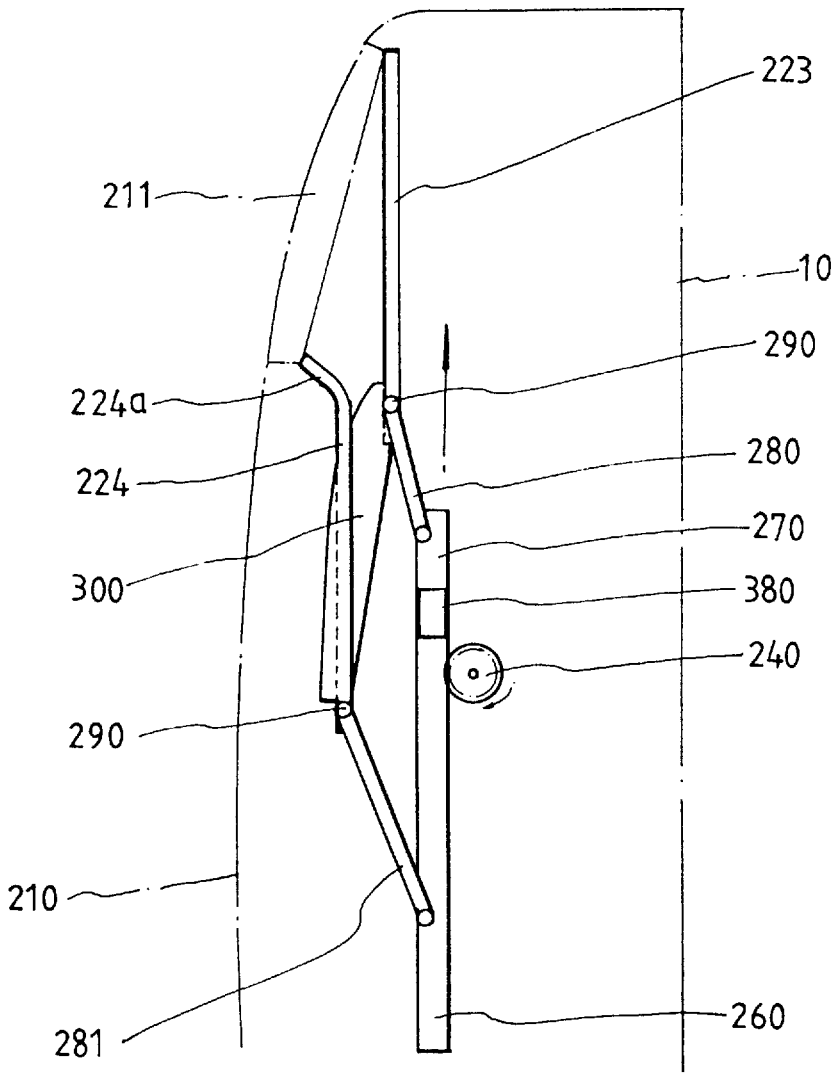

At this location, the open/close door 300 is descended in a reverse operation of the above-mentioned processes to thereby open the discharge outlet 211, as illustrated in FIG. 14.

SECOND EMBODIMENT

Reference numeral 200*a* is a discharge outlet open/close unit which is horizontally moved by a sliding motion generated by an inclination to thereby close the discharge outlet 211 after the open/close door 300 is vertically raised to the same level in height as that of the discharge outlet 211 according to a driving source.

In other words, the discharge outlet open/close unit 200*a* is disposed with the open/close door 300 which moves vertically and horizontally in order to close the discharge outlet 211 by being positioned at the same level in height as that of the front surface of the indoor unit body 10. Although respective means (described later) for moving the open/close door 300 are symmetrically positioned at both sides of the open/close door 300, the present invention will describe one side of the open/close door 300 for convenience of the description.

The open/close door 300 is protrudingly formed from a door plate 302 thereof to a rear side with an inclination plate 303 which is mounted at upper and lower sides thereof with a first and a second slide rod 400 and 410 protruding from the door plate 302 to the rear side.

The open/close door 300 is provided at a rear side thereof with first guide means 420 for a sliding link-up with the first and the second slide rod 400 and 410 so that the open/close door 300 can be horizontally guided.

The first guide mans 420 is mounted at one side thereof with medium means 430 coupled in such way as to be slid at one surface of the first guide means 420 and at an inclination plate 303 of the open/close door 300 so that the first guide means 420 can relatively and vertically moved and the open/close door 300 can be horizontally moved at the same time.

The medium means 430 is meshed at one side thereof with third driving means 440 to cause the medium means 430 to be vertically moved, and is disposed at the other side thereof with second guide means 450 fixed to an inner surface of the indoor unit body 10 for guiding the medium means 430 vertically, where the second guide means 450 is in turn coupled to the medium means 430 for a sliding link-up thereto.

The first and the second slid rod 400 and 410 are externally inserted at tip ends thereof by horizontally moving first and second resilient means 470 and 480 so as to apply a resilient restoring force to the horizontally-moving, door 300.

At this time, the first and second slide rod 400 and 410 are formed at tip ends thereof with head units 401 and 411 lest the horizontally-moving first and second resilient means 470 and 480 should be slipped therefrom.

The first guide means 420 is integrally formed wit a sliding means 490 which is inserted into a sliding groove (described later) at the medium means 430 and with an externally-exposed exposure member 500.

The sliding member 490 is arranged at an upper portion thereof with a guide rod 510 for guiding vertically-moving resilient means (described later) which is in turn supported by support means 491 and fixed to the sliding means 490.

The sliding member 490 is mounted at an upper portion thereof with vertically-moving resilient means 520 so as to apply a resilient restoring force to the vertically-moving medium means 430, and the exposure member 500 is formed with a through hole (no reference numeral designated) for the first and the second slide rod 400 and 410 to pierce therethrough.

The medium means 430 is formed at a lengthwise inner body 431 thereof with a sliding hole (no reference numeral designated) so that the sliding member 490 of the first guide means 420 and the guide rod 510 can be inserted and slid thereinto.

The body 431 is disposed at a lateral-surface thereof with a plurality of rollers 530 so as to roll along with the second guide means 450.

The open/close door 300 is disposed with an inclination plate 432 which is integrally formed with the body 431 so as to slide at the inclination plate 303 of the open/close door 300 to vertically move the door 300.

The inclination plate 432 is formed at an opposite lower area thereof with rack teeth 433 for the third driving means 440 to be meshed thereto.

Furthermore, at respective inclination plates 303 and 432 of the medium means 430 and the open/close door 300, there are formed inclination surfaces (no reference numerals designated) at which the medium means 430 moves vertically while the open/close door 300 moves horizontally.

The third driving means 440 is mounted with the rack teeth 433 which are in turn meshed to pinion 441 so as to vertically move the medium means 430, where the pinion 441 is connected to driving means (not shown) by an axle member 442.

The axle member 442 is rotatatively supported by a support member 443 fixed at a lateral wall of the indoor unit body 10.

The second guide means 450 is formed in a "T" shape at a section thereof, and a flange unit (no reference numeral designated) is secured to an inner surface of the indoor unit body 10 whereby a web portion (no reference numeral designated) thereof is coupled by a roller 530 of the medium means 430 by way of sliding link-up.

Next, an operational effect of the present invention according to the second embodiment thus constructed will be described.

Figure 18:
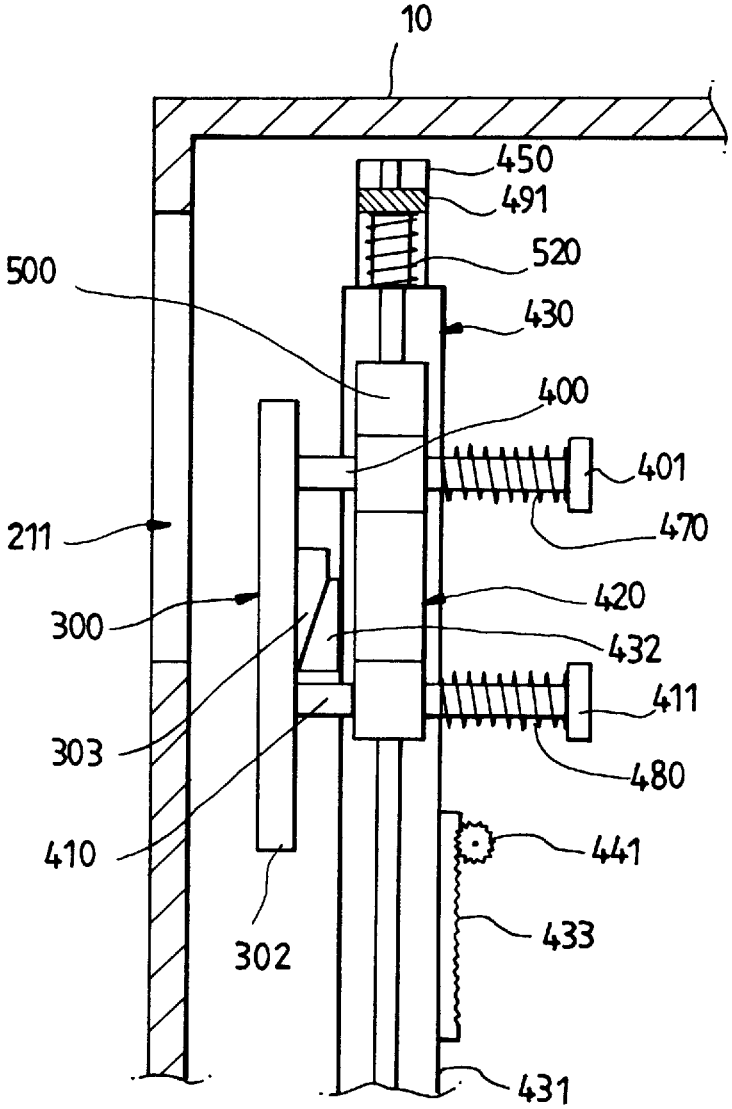

In case the discharge outlet 211 is to be closed at a discharge outlet opening and closing apparatus of an air conditioner, and when a control unit (not shown) is manipulated to apply a power to a motor (not shown), as illustrated in FIG. 18, a driving force of the motor is transmitted to the axle member 442 to thereby rotate the pinion 441.

Rotary motion of the pinion 441 serves to change the body 431 into performing a vertical movement by way of the rack teeth 433 formed at the body 431 of the medium means 430 to thereby cause the roller 530 at the medium means 430 to rise, riding on the second guide means 450.

At this time, the first guide means 420 is coupled to the medium means 430 and the open/close door 300 is coupled to the first guide means 420, so that the door 300 and the first guide means 420, so that the door 300 and the first guide means 420 are raised together.

Figure 19:
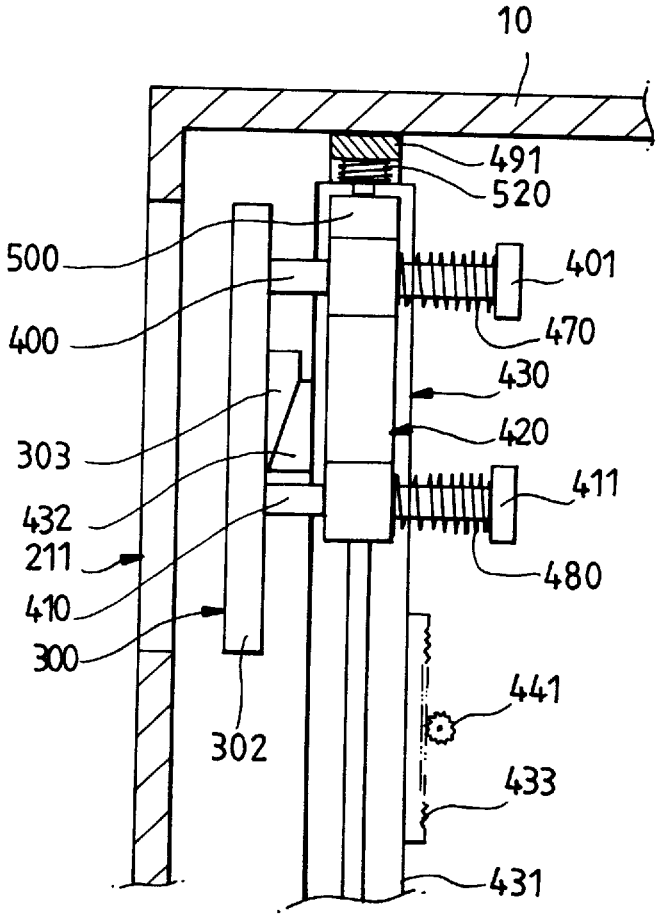

Next, as illustrated in FIG. 19, when the pinion 441 is kept rotating to thereby raise the medium means 430 in a state where a top upper surface of the first guide means 420, namely, an upper surface of the support means 63 is tangent to an inner upper surface of the indoor unit body 10, the medium means 430 serves to compress at an upper surface thereof the vertically-moving resilient means 520 because the first guide means 420 is restrained in its movement, and the medium means 430 is stuck at the inclination plate 432 thereof to the inclination plate 303 of the open/close door 300 to thereby apply a force thereto.

Subsequently, the first and the second slide rod 400 and 410 slide through the through hole of the first guide means 420, move to the left and compress the horizontally-moving first and second resilient means 470 and 480 because the open/close door 300 is constrained in its vertical movement.

Figure 20:
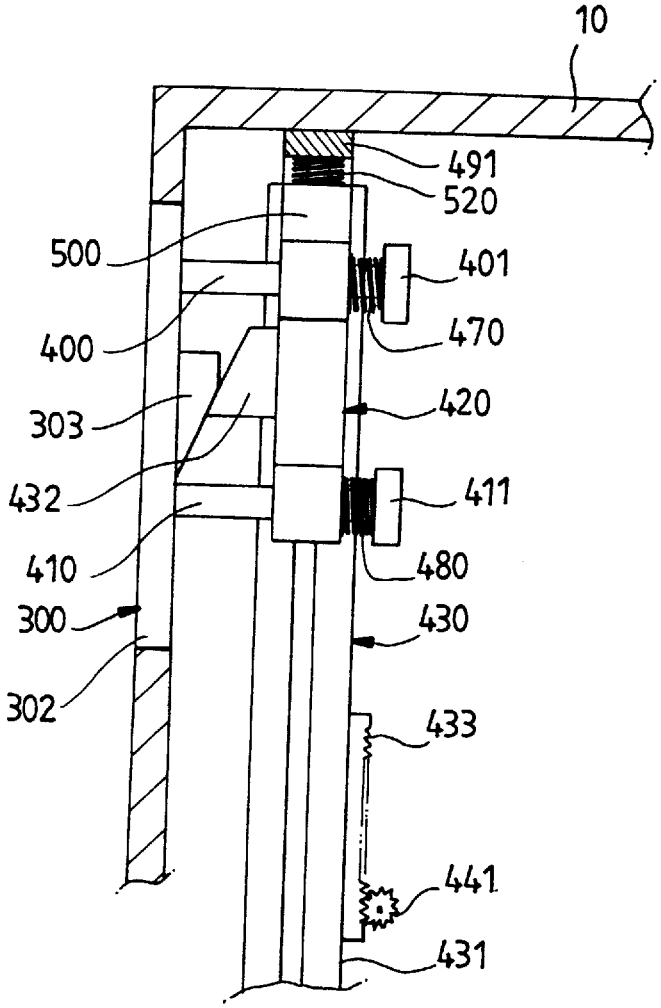
Figure 21:
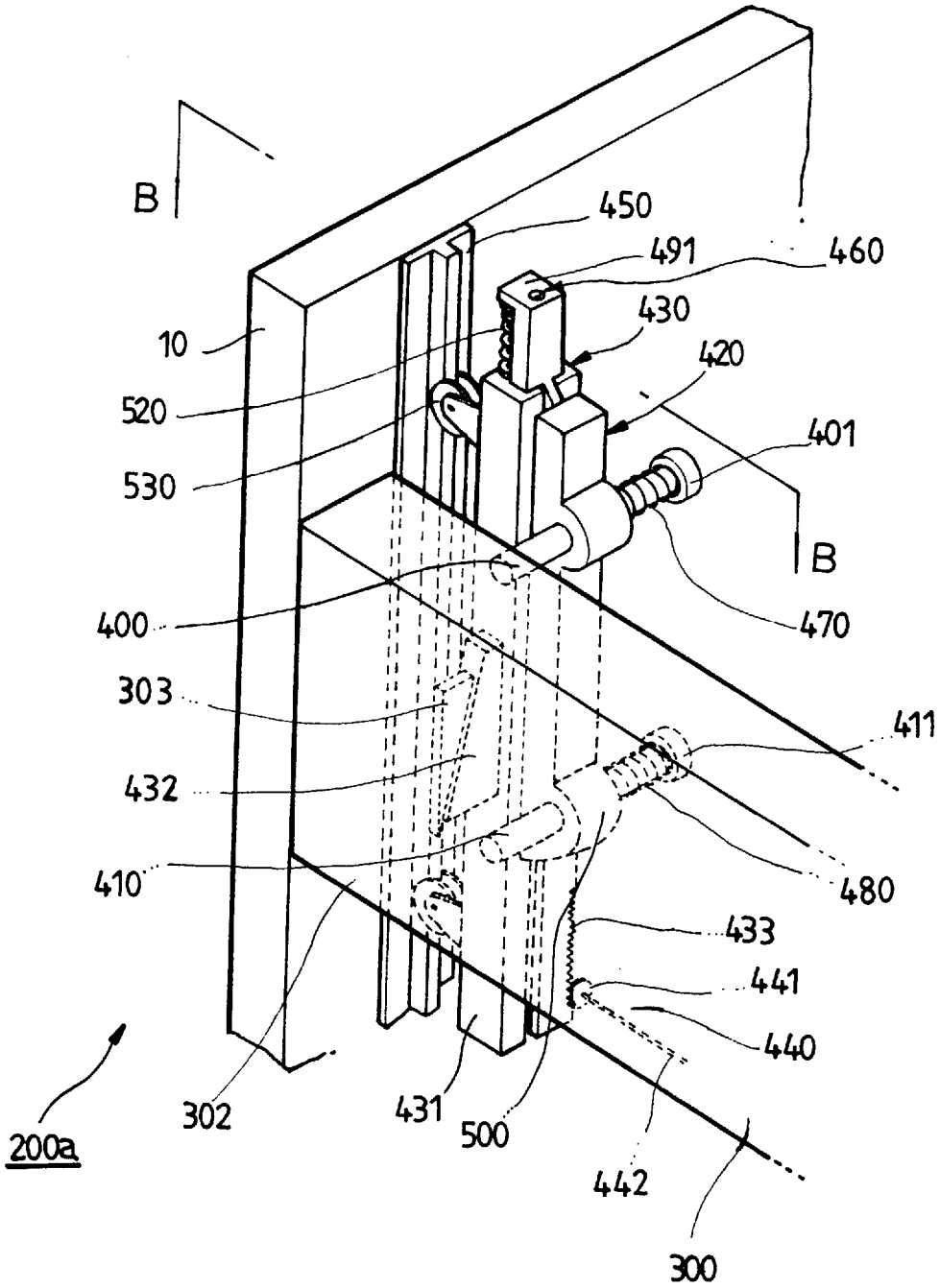
FIGS. 21 through 27 are drawings according to a third embodiment of the present invention where.
Figure 22:
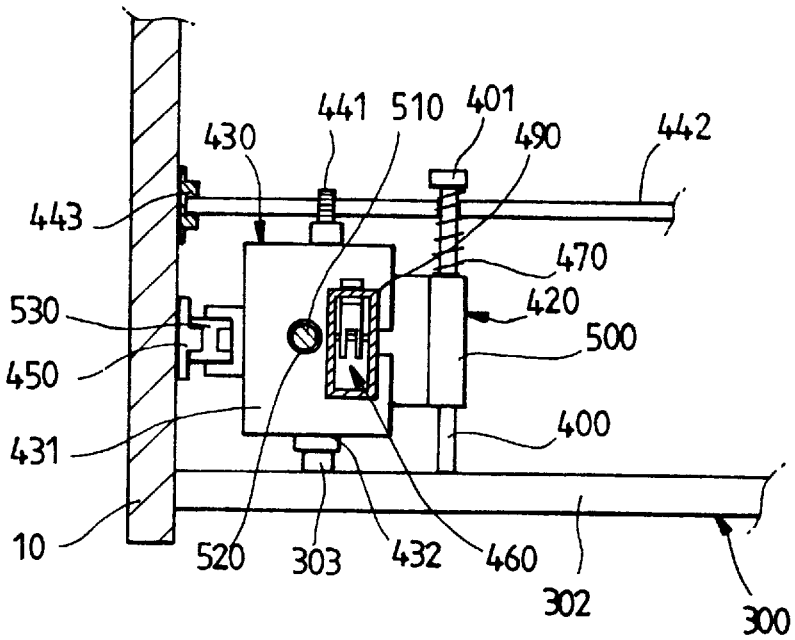
Figure 23:
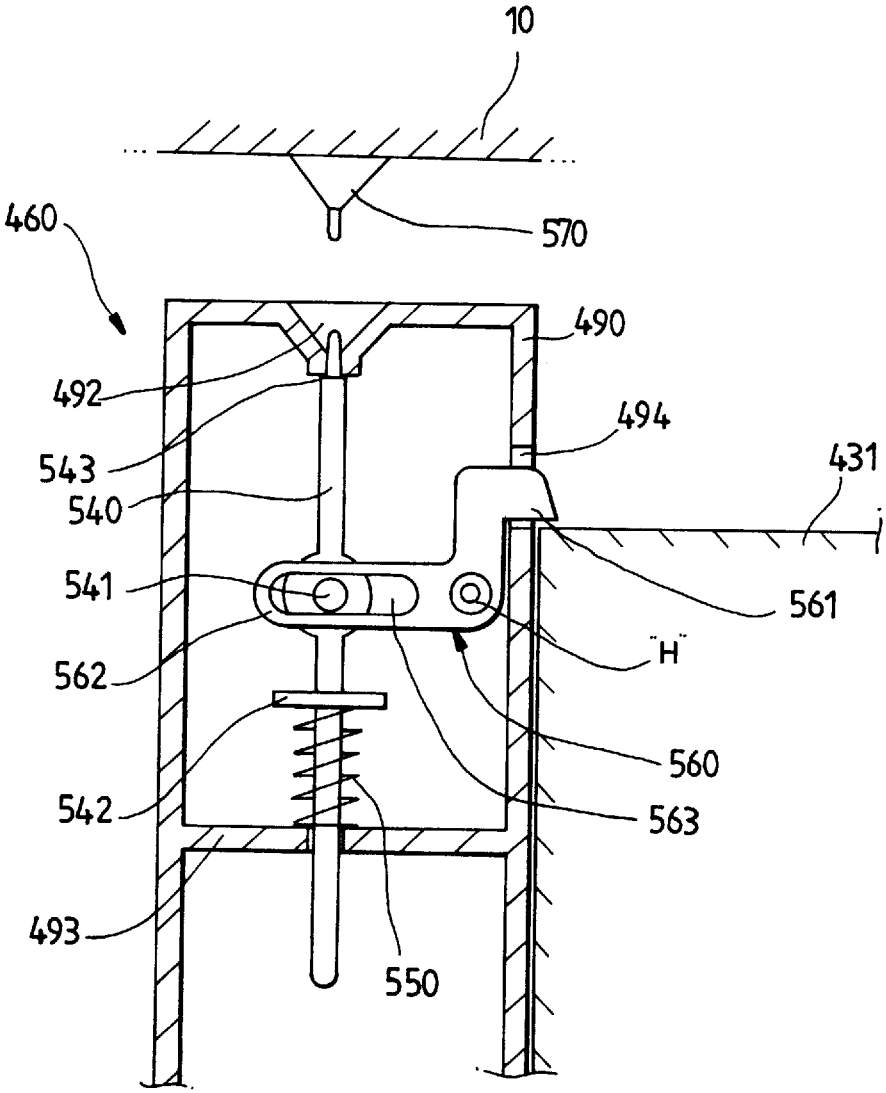
Figure 24:
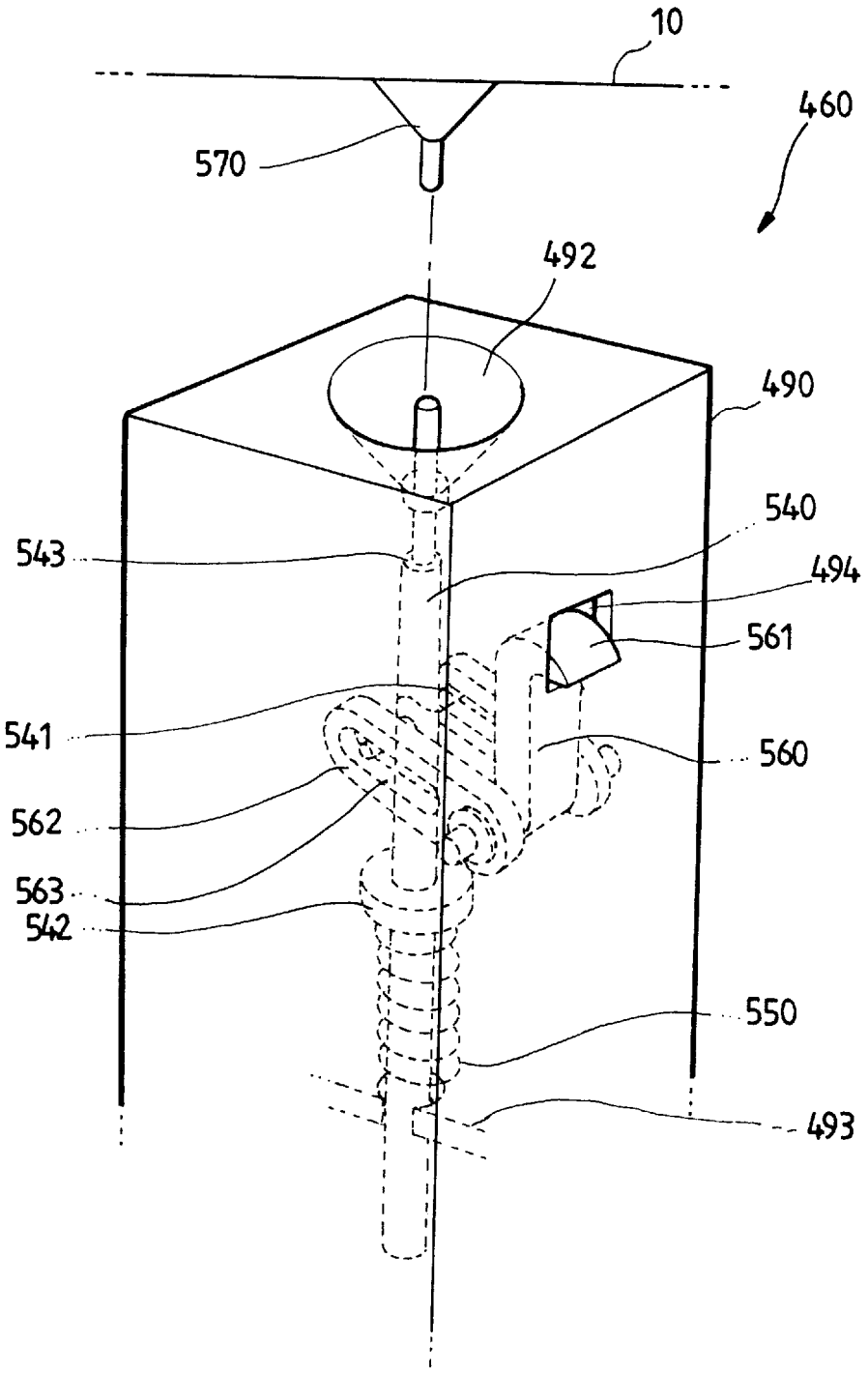

As illustrated in FIG. 20, when a front surface of the door plate 302 at the open/close door 300 is positioned at the same level as that of the indoor unit body 10, the driving means is stopped in its rotatation.

Meanwhile, the horizontally-moving first and second resilient means 470 and 480 is operated such that the open/close door 300 is always stuck at the inclination plate 303 thereof to the medium means 43 at the inclination 432 thereof, and the vertically-moving resilient means 520 is so operated as to cause the medium means 430 and the first guide means 420 to be stuck together at all times, which serves to enhance the reliability of the open/close door 300 and the first guide means 420.

When the open/close door 300 is to be opened, the door can be opened in the reverse operation mentioned above.

Now, the third embodiment of the present invention will be described in detail with reference to FIGS. 21 through 27.

THIRD EMBODIMENT

Throughout the drawings, like reference numerals and symbols as in the first and the second embodiment are used for designation of like or equivalent parts or portions, for simplicity of illustration and explanation.

Reference numeral 460 is safety means disposed at an upper side of the first safety means 420, which controls movement of the medium means 430 according to necessity thereof and allows the medium means 430 to move horizontally only when the door 300 completes a vertical movement for closing the discharge outlet 211.

In other words, the safety means 460 is disposed at an inner upper area of the first guide means 420 with an operational rod 540, which is outwardly inserted at a bottom area thereof with resilient means 550 in order to apply resilient restoring force thereof.

A hitcher 560 is slidingly coupled to the operational rod 540 so as to be hitched at an upper surface of body 431 at the medium means 430 and simultaneously hinged to an inner are of sliding member 490 at the first guide means 420.

A protruding member 570 is formed at an inner upper surface of the indoor unit body 10 so as to push the operational rod 540 when the first guide means 420 is adhered to an inner upper surface of the indoor unit body 10.

At this time, the first guide means 420 is formed at an upper surface of the sliding member 490 of the first guide means 420 with a concave portion 492 having a through hole thereon so as to accommodate an upper tip end of the operational rod 540 and to simultaneously guide same.

The concave portion 492 is formed thereunder with a diaphragm 493 having a through hole thereon so as to guide a lower portion of the operational rod 540 and to simultaneously accommodate same.

The sliding member 490 is formed at a lateral surface thereof with a rectangle-like through hole 494 so that a jawed portion of the hitcher 560 can be accessed thereto.

The operational rod 540 is formed at n intermediate portion thereof with a rod-like wing unit 541 protruding toward both sides thereof at a right angle against a lengthwise direction of the operational rod 540 so as to be inserted into a sliding groove (described later) of the hitcher 560.

The wing unit 541 is formed thereunder with a disk-shaped protruding plate unit 542 in a peripheral direction of the operational rod 540 so as to restrain the resilient means 550.

The hitcher 560 is so protruding that a jawed portion 561 can be hitched at an upper surface of the body 431 of the medium means 430.

The hitch 560 is constructed such that two legs 562 disposed thereunder are hitch by the wing unit 541 of the operational rod 540 to thereafter be slid, where the two legs 562 are formed therebetween with an oval hole 563 so that the wing unit 541 can be inwardly inserted.

Next, an operational effect of the third embodiment according to the present invention thus constructed will be described.

Figure 25:
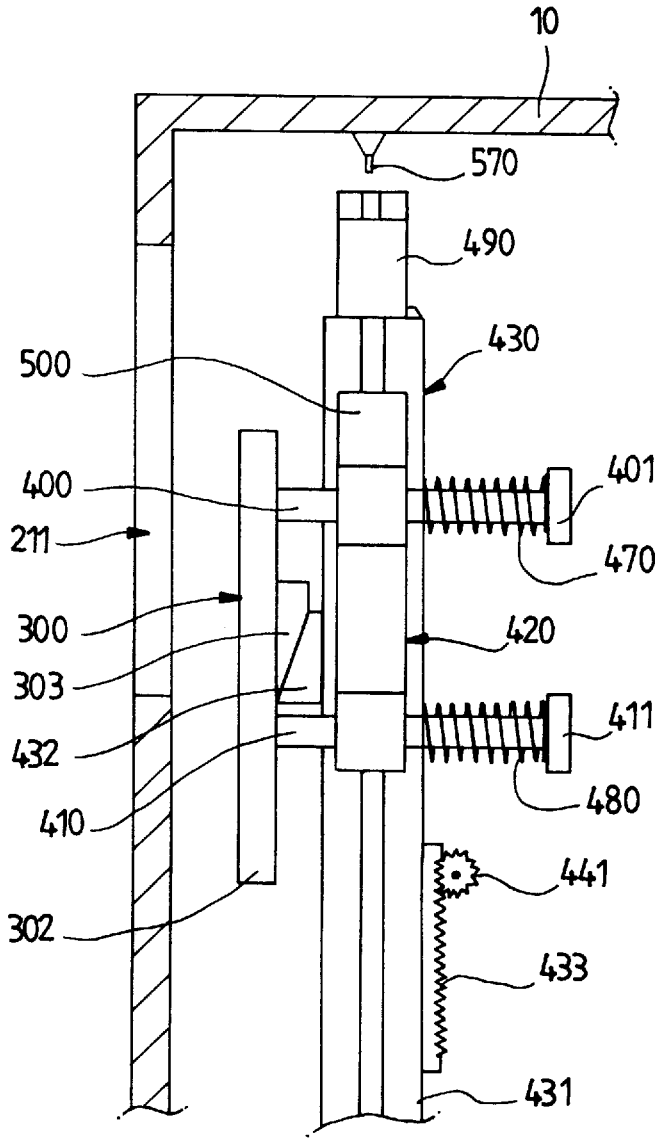
Figure 26:
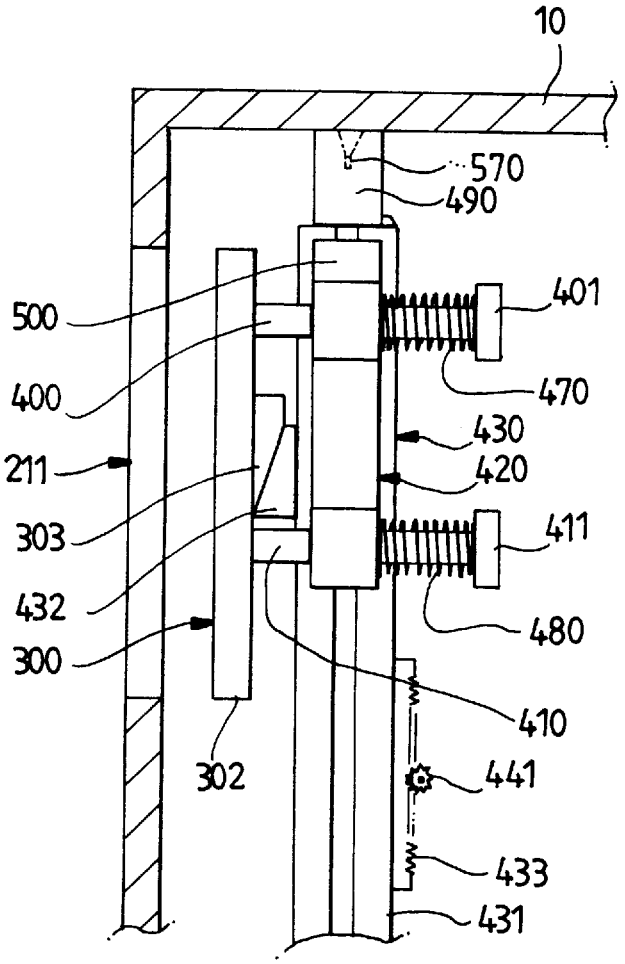

When the discharge outlet 211 is to be closed at the discharge outlet opening and closing apparatus of the air conditioner, a control unit (not shown) is manipulated, as illustrated in FIG. 25, to thereby apply a power to driving means (not shown). A driving force of the driving means is transmitted to the axle member 442 to rotate the pinion 441.

Successively, the hitcher 560 at the safety means 460 is rotated around a hinge point (H) to a direction (by way of example, clockwise direction), as illustrated in FIG. 25, by the operational rod 540 pushed upwards by the resilient means 550 and the jawed portion 561 thereof is exposed outside to thereafter be hitched by an upper surface of the body 43 at the medium means 430.

Furthermore, the pinion 441 is changed from rotary motion thereof to a vertical motion of the body 431 by the rack tooth 433 formed at the body 431 of the medium means 430, so that roller 530 of the medium means 430 rides up on the second guide means 450.

At this time, because the first guide means 420 is coupled to the medium means 430 and the open/close door 300 is coupled to the first guide means 420, the open/close door 300 and the first guide means 420 are also ascended.

Next, when an upper end surface of the first guide means 420, in other words, an upper surface of the sliding member 490 contacts an inner upper surface of the indoor unit body 10 and is inserted into the concave portion 492 of the sliding member 490 to thereby push an upper end of the operational rod 540, the operational rod 540 overcomes the resilient restoring force of the resilient means 550 and moves downward, whereby the wing unit 541 of the operational rod 540 slides on the oval hole 563 of the hitcher 560 and simultaneously descends the legs 562 downward.

Successively, the hitcher 560 is rotated around the hinge point (H) in the reverse direction (by way of example, counterclockwise direction), while the jaw portion 561 is separated from the upper surface of the body 431 of the medium means 430 to thereafter be inserted into the sliding member 490.

In this location, when the pinion 441 is continuously rotated to thereby cause the medium means 430 to ascend, the medium means 430 compresses at an upper surface, thereof the vertically moving resilient means 520 because the first guide means 420 is restrained of its movement, and the medium means 430 adheres at an inclination plate 432 thereof to an inclination plate 303 of the open/close door 300 to thereby apply a force thereto.

Accordingly, the first and the second slide rod 400 and 410 slide through the through hole of the first guide means 420 and moves to the left to thereby compress the horizontally-moving first and second resilient means 470 and 480, because the open/close door 300 is restrained of its movement to the vertical direction.

Figure 27:
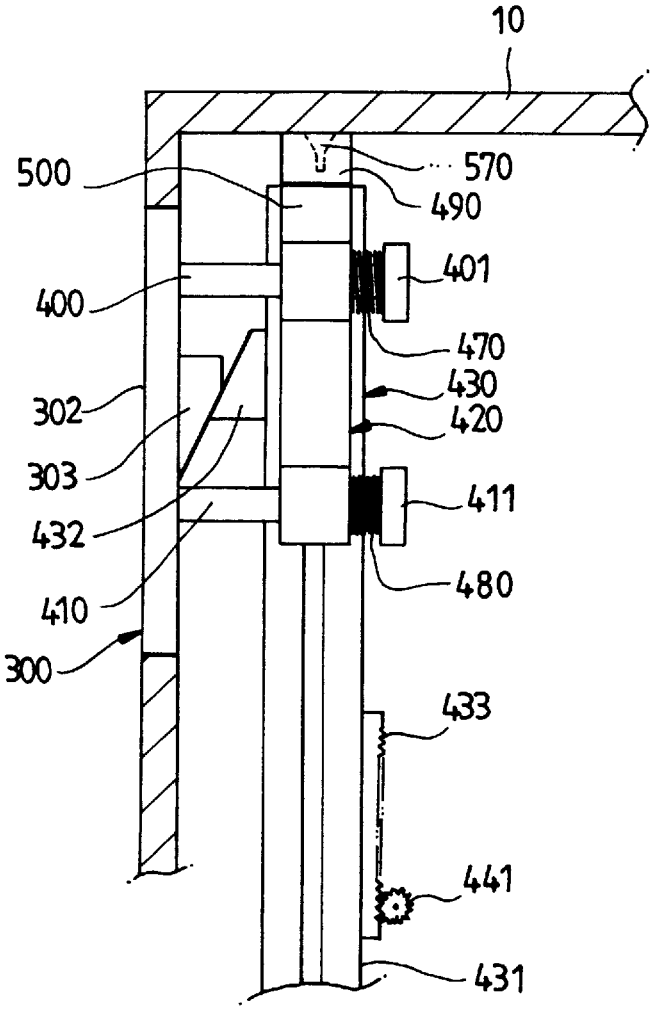

As illustrated in FIG. 27, when the front surface of door plate 302 at the open/close door 300 is positioned at the same level as that of the indoor unit body 10, the driving means stops its rotation.

Figure 5:
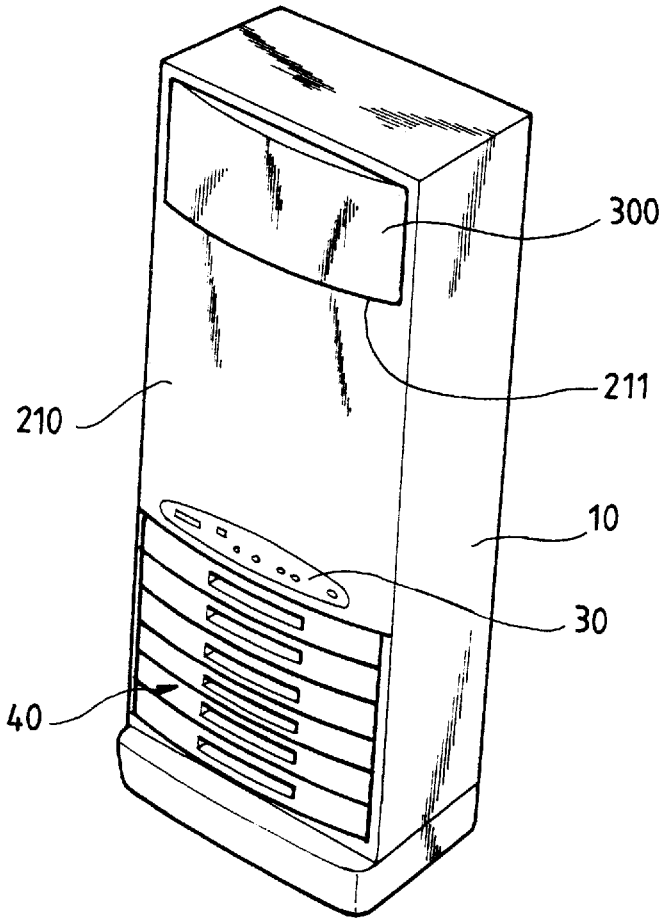
FIGS. 5 through 15 are drawings according to a first embodiment of the present invention where.

Furthermore, as illustrated in FIG. 5, when the open/close door 300 is closed, the front surface of cabinet 31 and an external surface of the open/close door 300 are positioned at the same level, so that there is no fear of the foreign objects such as dust and the like being accumulated at the discharge outlet 211 and the external appearance of the air condition is beautified.

Meanwhile, even through the first guide means 420 is restrained of its vertical movement by an external force while it is ascended, the hitcher 560 of the safety means 460 is hitched at the upper surface of the body 431 at the medium means 430 to prevent the open/close door 300 from performing the horizontal movement and to thereby prevent same from colliding with an inner front surface of the indoor unit body 10.

Still furthermore, because the horizontally-moving first and second resilient means 470 and 480 are so operated as to cause the inclination plate 303 of the open/close door 30 to be always adhered to the inclination plate 432 of the medium means 430, the vertically-moving resilient means 520 serves to cause the medium means 430 and the first guide means 420 to be always glued to thereby increase reliability of operation at the open/close door 300 and the first guide means 420.

Although the above invention has been described in detail with reference to its presently preferred embodiment about a discharge outlet opening and closing apparatus of an air conditioner which can transfer a power from the third driving means 440 to the medium means 430 according to a rack and a pinion, it will be understood by one of ordinary skill in the art that various modifications can be made without departing from the spirit and scope of the invention.

By way of example, it should be apparent that a construction so devised as to transfer the power by way of a worm, a worm wheel, a belt and the like can be included within the spirit and the scope of the invention.

As apparent from the foregoing, there is an advantage in the discharge outlet opening and closing apparatus of an air condition according to the first, second and third embodiment of the present invention, in that an open/close door can be raised by a driving source according to a second movement where a pinion, a rack gear and a link are cooperatively activated and simultaneously moved forward in position thereof, to cause a side width surface of a discharge outlet to corresponding with that of the open/close door, so that a staired gap against the side width surface against the side width surface can be eliminated to thereby beautify an external appearance of the air conditioner.

What is claimed is:

1. A discharge outlet opening and closing apparatus of an air conditioner employing an open/close door for preventing foreign objects and the like from entering a discharge outlet opened at a front panel at a predetermined size when the air conditioner is stopped of its operation, the apparatus comprising:

left and right guide means arranged at the rear of the front panel such that a plurality of wind direction horizontal blades can be rotatively supported at the discharge outlet and vertical movement of the open/close door can be guided;

support means disposed at the rear of the front panel such that a plurality of wind direction vertical blades can be rotated at the discharge outlet;

first driving means disposed at the support means to thereby be driven bidirectionally; and power transmission means provided at the support means so as to receive a power of the first driving means to vertically move the open/close door.

2. The apparatus as defined in claim 1, wherein the left and right guide means comprise:

a plurality of binge holes respectively formed up and down each being disposed at a predetermined spacing from an intermediate height to an uppermost height thereof against both lateral walls thereof, so that the horizontal wind direction blades can be symmetrically and freely operated;

an upper rail groove formed between an intermediate height and an uppermost height thereof against both inner lateral walls thereof so as to vertically guide joint boxes respectively disposed at both upper lateral sides of the open/close door; and a lower rail groove formed between an intermediate height and an uppermost height thereof against both inner lateral walls thereof as so to horizontally guide joint boxes disposed at both lower lateral sides of the open/close door.

3. The apparatus as defined in claim 2, wherein the upper rail groove is straightly formed such that the open/close door can be so guided as to be vertically operated.

4. The apparatus as defined in claim 2, wherein the lower rail groove is formed in ⌈-shaped such that the open/close door can be so guided as to be vertically operated and simultaneously the open/close door can be operated at a lower end thereof from a predetermined position to a horizontal direction.

5. The apparatus as defined in claim 4, wherein the lower rail groove is formed at an upper end thereof with a bent unit horizontally bent at a predetermined inclination so that the open/close door can be horizontally and forwardly moved at a lower end thereof toward the discharge outlet to thereby eliminate a staired gap between a lower width of the open/close door and that of the discharge outlet.

6. The apparatus as defined in claim 2, wherein the upper and the lower rail grooves are opened at lower end thereof toward external sides the left and right guide means so that the plurality of joint boxes can be accessed at one end thereof for mutual hinged coupling.

7. The apparatus as defined in claim 1, wherein the support means comprise:

a position fitting unit protrudingly disposed at a rear central portion thereof so that a rack guide member for guiding a vertical motion of a rack gear cannot be horizontally swayed;

a plurality of snap protruders and fastening screw holes disposed at an upper section and a lower section thereof to allow an upper end and a lower end of the rack guide member to be respectively fitted thereinto;

a driving means fixing accommodation unit disposed at a right side of the position fitting unit and mounted with a pinion through hole to allow a first driving means to be insertedly mounted through a front side thereof;

a sensor fixing unit disposed at a left side of the position fitting unit and protruding mounted so that a photo sensor for position-detecting a vertical motion of the rack gear can be inserted from forward to backward;

a plurality of screw through holes formed at both ends thereof so as to be correspondingly fastened to both rear inner walls of the front panel; and a left and right blade support unit formed at an upper surface thereof in a bent shape so as to support the plurality of horizontal wind direction blades.

8. The apparatus as defined in claim 1, wherein the support means is formed at upper surface thereof with a left and right blade support unit for supporting a lower end of the vertical wind direction blades being bent at a right angle.

9. The apparatus as defined in claim 8, wherein the left and right blade support unit comprises:

a plurality of hinge holes formed between both upper ends thereof, each being spaced out at a predetermined interval, so that a lower end of the plurality of horizontal wind direction blades can be fitted for free vertical rotation; and a second driving means disposed at an upper end thereof for horizontally moving the plurality of vertical wind direction blades.

10. The apparatus as defined in claim 9, wherein the second driving means comprises:

an accommodation unit integrally formed at an upper end of the left and right blade support unit;

a plurality of snap protruders formed at an opening located above the accommodation unit; and a lid plate mounted with a snap hole and a screw through hole corresponding to the fastening screw hole.

11. The apparatus as defined in claim 1, wherein the support means comprises a rack guide member for guiding a rack gear of the power transmission means to accurately operate vertically without being swayed horizontally.

12. The apparatus as defined in claim 11, wherein the rack guide means comprises:

a cut-out portion opened at a central front portion thereof and at upper and lower surfaces thereof to allow the rack gear and to thereafter be horizontally operated, and to allow the pinion to pass there through at a midsection of a right side wall thereof and to be meshed with the rack gear; and a flange unit having a plurality of fixing holes at both side walls thereof against an upper end and a lower end thereof so as to be respectively and correspondingly fitted to the plurality of snap protruders and fastening screw holes formed at the rear of the support means.

13. The apparatus as defined in claim 1, wherein the power transmission means comprises:

a rack gear disposed at the rear side of the support means so as to be vertically moved according to the pinion which receives a power of the first driving means to thereafter be rotated;

a fixing member resiliently disposed at an upper end of the rack gear so as to be simultaneously raised according to rotation of the pinion to thereafter be stopped by collision with an external force when the rack gear is ascended and at the same time to narrow a gap between the fixing member and the rack gear according the rack gear and damper action;

an upper and lower connecting member so hinged that the rack gear and the fixing member can respectively be articulated thereto; and a plurality of joint boxes simultaneously hinged to the open/close door, upper and lower connecting member and left and right guide means so that the open/close door can receive guidance from the left and right guide means to thereafter perform vertical motions.

14. The apparatus as defined in claim 13, wherein the rack gear resiliently disposed at a lower end of the fixing member which is raised along with the fixing member according to the rotating of the pinion and is further raised up be the damper action to thereby narrow a gap with the fixing member when the fixing member is collided by an external force and stopped thereby.

15. The apparatus as defined in claim 13, wherein the rack gear comprises:

gear teeth vertically meshed with the pinion at one side wall thereof;

an accommodation disposed at an upper end thereof for being inserted through an upper side of the fixing member to thereby perform a vertical-direction dampening action;

a hitching groove for allowing the fixing member to be inserted into the accommodation unit for a resilient coupling therebetween; and a rib mounted with an axle hole at a lower rear end thereof for allowing the lower connecting member to be inserted thereinto for vertical rotation.

16. The apparatus as defined in claim 15, wherein the axle hole is respectively provided at both inner surfaces thereof with a bearing by way of serration method so as to minimize abrasion caused by rotary movement of a lower link when the lower connecting member is hinged to vertically be rotated.

17. The apparatus as defined in claim 16, wherein the bearing is arranged therein with a bush having the same width as that of the rib and forcibly inserted thereinto.

18. The apparatus as defined in claim 15, wherein the accommodation unit is mounted at a floor surface thereof with a damper fixing pin for preventing the damper member from being bolted therefrom so that the damper member can accurately perform the dampering action vertically.

19. The apparatus as defined in claim 13, wherein the fixing member comprises;

an insertion unit disposed thereunder for the damper member to be inserted thereinto for dampering operation;

a hook protruder formed in partial cut-out at both upper lateral walls thereof so as to be resiliently coupled to a hitching groove formed at the rack gear; and a rib having an axle hole at a rear upper surface thereof for the connecting member to be inserted thereinto for vertical rotation.

20. The apparatus as defined in claim 19, wherein the insertion unit is equipped at a ceiling thereof with a damper fixing pin for preventing the damper member from bolting therefrom so that the damper member can perform an accurate dampering operation vertically.

21. The apparatus as defined in claim 19, wherein the hook protruder comprises:

a horizontal jaw formed at an upper surface thereof for preventing the fixing member from being separated from an upper area of the rack gear by being hitched by an upper surface of the hitching groove formed at the rack gear; and a slant jaw formed thereunder for sliding to narrow a gap therebetween by way of a stopping force from the fixing member which has been adhered to a bottom surface of the hitching groove and by way of an ascending force of the rack gear.

22. The apparatus as defined in claim 19, wherein the axle hole comprise:

bearings respectively fitted into both inner surfaces thereof by way of serration method; and a bush forcibly inserted into the inner surfaces of the hearings, having the same width as that of the rib.

23. The apparatus as defined in claim 19, wherein the damper member is a compressed spring.

24. The apparatus as defined in claim 19, wherein the damper member is adhered at a lower end thereof to a floor surface of the accommodation unit formed at the upper end of the rack gear and simultaneously adhered an upper end thereof to a ceiling of the insertion unit formed at a lower end of the fixing member.

25. The apparatus as defined in claim 13, wherein the upper and the lower connecting member comprises:

a rib having an axle hole formed in a central front of the fixing member and the rack gear can be respectively hinged thereto through the medium of a hinge axle; and a hinge pin protrudingly disposed at both rear ends of the open/close door so as to be hinged to the open/close door through the media of the joint boxes.

26. The apparatus as defined in claim 13, wherein the joint boxes simultaneously couple in one line the upper and the lower connecting members the open/close door, left and right guide means.

27. The apparatus as defined in claim 13, wherein the joint boxes are coupled at one side thereof to an external periphery of the hinge pin protruded at the upper and lower link through both upper and lower lateral walls of the open/close door and simultaneously are coupled at the other end thereof with the upper and lower rail grooves formed at the left and right guide means.

28. The apparatus as defined in claim 13, wherein the plurality of joint boxes comprise:

a hollow axle unit having at least one hooked protruder formed at an external surface thereof which is resiliently pierced through a lateral wall of the open/close door to thereafter be forcibly fitted to an external surface of the hinge pin protruded at both ends of the upper and the lower connecting member; and an axle unit formed at the other end thereof so as to be selectively inserted into left and right rail grooves of the left and right guide means to thereafter be slid therein; and a flange unit formed between the hollow axle unit and the axle unit with a larger diameter than external diameters thereof to thereafter be such to an external wall of the open/close door and to function as a washer.

29. The apparatus as defined in claim 13, wherein the joint boxes respectively disposed at both upper lateral walls of the open/close door are respectively fitted into the upper rail groove of the left and right guide means.

30. The apparatus as defined in claim 13, wherein the joint boxes respectively formed at both lower lateral walls of he open/close door are respectively fitted into the lower rail groove of the left and right guide means.

* * * * *